US007145069B2

(12) United States Patent
Berg

(10) Patent No.: US 7,145,069 B2
(45) Date of Patent: Dec. 5, 2006

(54) MOTORIZED PAGE TURNER

(76) Inventor: Raymond J. Berg, 3975 Farmhill Ct., Mound, MN (US) 55364

( * ) Notice: Subject to any disclaimer, the term of this patent is extended or adjusted under 35 U.S.C. 154(b) by 187 days.

(21) Appl. No.: 10/946,489

(22) Filed: Sep. 21, 2004

(65) Prior Publication Data

US 2006/0060064 A1 Mar. 23, 2006

(51) Int. Cl.
*G10G 7/00* (2006.01)

(52) U.S. Cl. ..... 84/486; 84/487; 84/488; 84/500; 40/531

(58) Field of Classification Search ..... 84/486–490; 40/531, 476
See application file for complete search history.

(56) References Cited

U.S. PATENT DOCUMENTS

| | | | | |
|---|---|---|---|---|
| 3,281,974 | A * | 11/1966 | Jensen | 40/531 |
| 3,608,420 | A | 9/1971 | Hazelett | |
| 3,732,773 | A | 5/1973 | Bombardi | |
| 4,072,080 | A | 2/1978 | Conlin | |
| 4,084,468 | A | 4/1978 | Butler | |
| 4,160,334 | A * | 7/1979 | Willis | 40/531 |
| 4,593,597 | A | 6/1986 | Albrecht et al. | |
| 4,632,007 | A | 12/1986 | Turcsany et al. | |
| 4,780,977 | A | 11/1988 | Howard et al. | |
| 4,936,034 | A | 6/1990 | Chen et al. | |
| 5,052,266 | A | 10/1991 | Burster | |
| 5,203,248 | A | 4/1993 | Carr et al. | |
| 5,233,900 | A | 8/1993 | Fitzgerald | |
| 5,247,755 | A | 9/1993 | Sato et al. | |
| 5,373,772 | A | 12/1994 | Shennoul | |
| 5,575,097 | A | 11/1996 | Chou et al. | |
| 5,962,801 | A | 10/1999 | Bowman et al. | |
| 6,107,558 | A | 8/2000 | Cowan | |
| 6,215,058 | B1 | 4/2001 | Molchak et al. | |
| 6,457,398 | B1 | 10/2002 | Wong | |

* cited by examiner

*Primary Examiner*—Gary F. Paumen
(74) *Attorney, Agent, or Firm*—Kinney & Lange, P.A.

(57) ABSTRACT

The motorized page turning device automatically turns the pages of a multiple-page musical composition silently and accurately. Each page of the musical composition is attached to a respective shuttle. Each shuttle is rotatably connected to a shaft and has two opposing notches at a bore passing through each shuttle. A drive pin passes normally through a main shaft portion of the shaft and individually mates with the notches of each shuttle. The main shaft is connected to a rotational drive motor which rotates the shaft and a respective shuttle approximately 180 degrees. A linear drive sleeve of the shaft is connected to a linear drive motor which axially advances the shaft and drive pin to the next shuttle.

33 Claims, 23 Drawing Sheets

MOTORIZED PAGE TURNER

CROSS-REFERENCE TO RELATED APPLICATION(S)

None.

BACKGROUND OF THE INVENTION

The present invention relates to a portable page turning device. In particular, the present invention relates to a motorized page turner for use when playing a multiple-page musical composition.

When playing a musical composition, the musician must typically turn numerous pages due to the length of the piece. The need to constantly turn pages presents a limitation for an individual playing a musical instrument because the individual's hands are not free to turn the pages. In order to turn a page, the individual must stop playing. This is not only cumbersome, but also creates an undesirable break in the music each time the individual turns a page of the composition. A potential solution for the musician is to have a person stand in close proximity to the music stand to turn the pages at the appropriate times. However, this is not always a practical solution, as it requires a second individual to be present throughout the piece.

Prior page turning device designs are known, but can be bulky and create excess noise when turning pages. Specifically, page turning devices which utilize motors or gears to turn pages of a composition can cause a noisy disturbance to the person playing the music as well as to the audience if the motors or gears are not well kept. In addition, complicated page turning devices that require heavy or large parts are difficult to transport from location to location, restricting their mobility. Another problem arises when the page turning device does not individually separate each page of the composition. Static friction can cause the page directly behind the page being turned to cling to the page being turned and result in multiple pages being turned at once. As a result, the musician is reading, and thus playing, the wrong page of music.

Thus, there is a need in the art for a motorized page turner that is portable, silent, and accurate.

BRIEF SUMMARY OF THE INVENTION

The motorized page turning device of the present invention turns the pages of a musical composition silently and accurately and can be easily transported from location to location. The pages of the musical composition are attached to a plurality of shuttles rotatably connected to a shaft. The shaft includes a main shaft having an upper and a lower portion, a linear drive sleeve, and a drive pin which sequentially mates with each shuttle. A first motor rotates the main shaft and one of the plurality of shuttles approximately 180 degrees. After a pre-set time delay, a second motor axially advances the linear drive sleeve relative to the main shaft such that the drive pin selects the next shuttle. Both motors are controlled by a logic circuit which also senses axial and rotational motion of the shaft and shuttles.

While the above-identified figures set forth preferred embodiments of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention.

DETAILED DESCRIPTION

Figure 1:
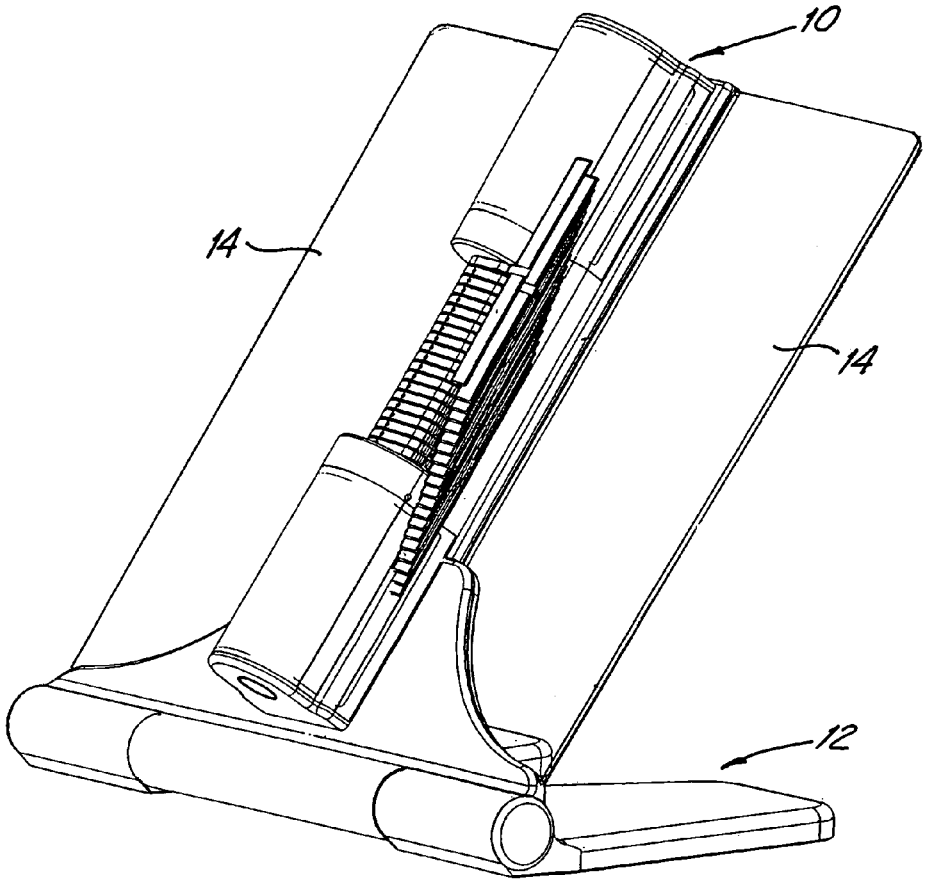
FIG. 1 is a front perspective view of a motorized page turning device of the present invention mounted on an adjustable support.

FIG. 1 depicts a motorized page turning device 10 of the present invention. Motorized page turning device 10 is shown mounted on an adjustable support 12, but can also be mounted on a traditional music stand. Adjustable support 12 is self-standing and can be positioned at varying angles relative to the user. Page turning device 10 is maintained in adjustable support 12 so that as adjustable support 12 tilts, page turning device 10 tilts with adjustable support 12. In a preferred embodiment, a pair of plates 14 are positioned on either side of page turning device 10 to provide support to the pages attached to page turning device 10. The musician can thus angle the pages of music attached to page turning device 10 at an angle which provides maximum readability.

Figure 2:
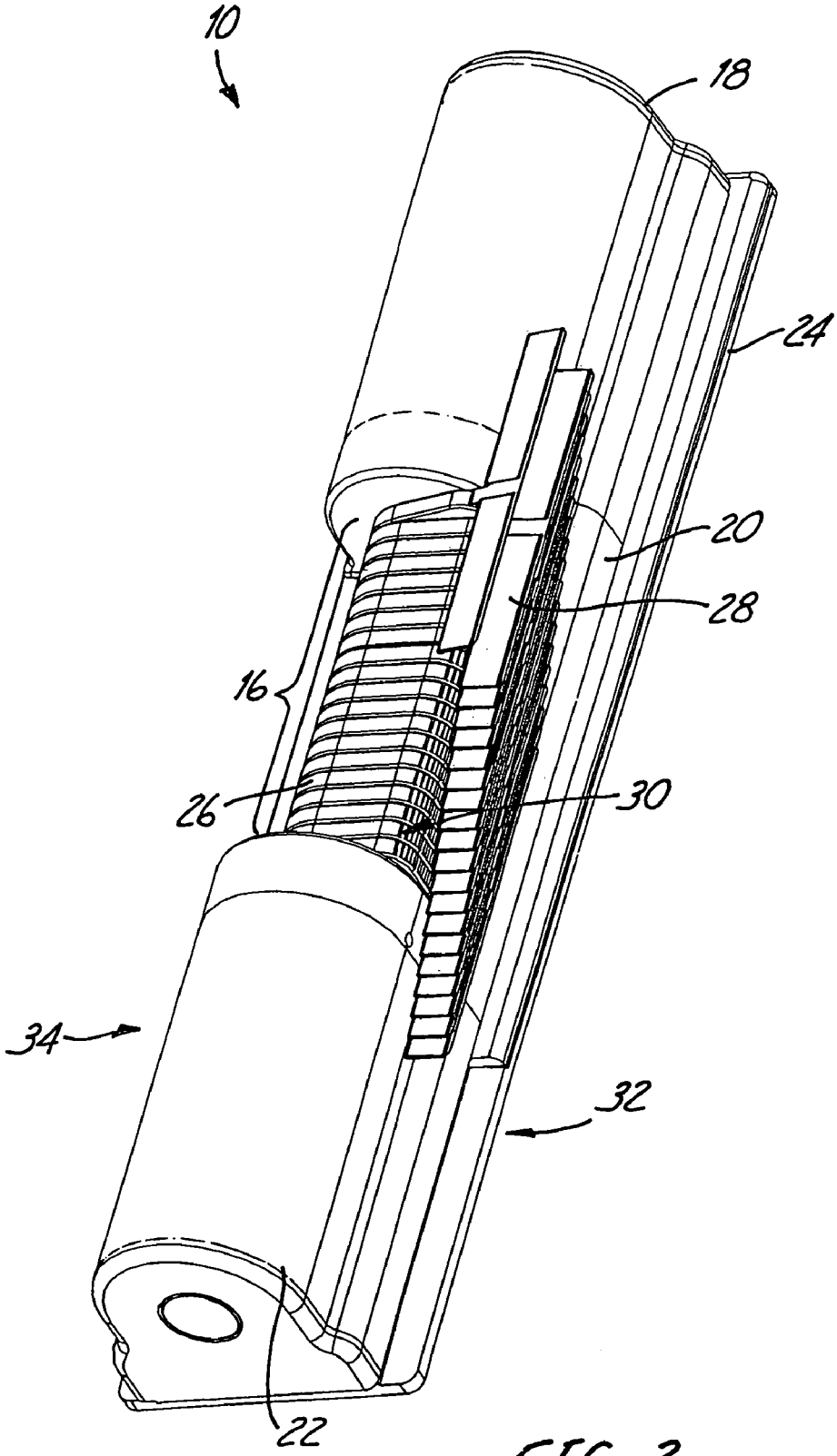
FIG. 2 is a front perspective view of the motorized page turning device of the present invention.

To better illustrate motorized page turning device 10 of the present invention, FIG. 2 is an enlarged perspective view of motorized page turning device 10 shown in FIG. 1. Motorized page turning device 10 generally comprises a shuttle assembly 16, top housing 18, center housing 20, bottom housing 22, and backplate 24. Shuttle assembly 16 is comprised of a plurality of shuttles 26 and clips 28 and is rotatably connected to page turning device 10 between top and bottom housings 18 and 22 at center housing 20. Each shuttle 26 of shuttle assembly 16 has a clip 28 attached to a first side 30 of the shuttle 26. The clip 28 operatively attaches its corresponding shuttle 26 to a piece of paper. When in a first position, shuttle assembly 16 is positioned at a first side 32 of page turning device 10. To turn the pages attached to clips 28, each shuttle 26 and corresponding clip 28 rotates approximately 180 degrees to a second position at a second side 34, opposite first side 32, of page turning device 10.

Figure 3:
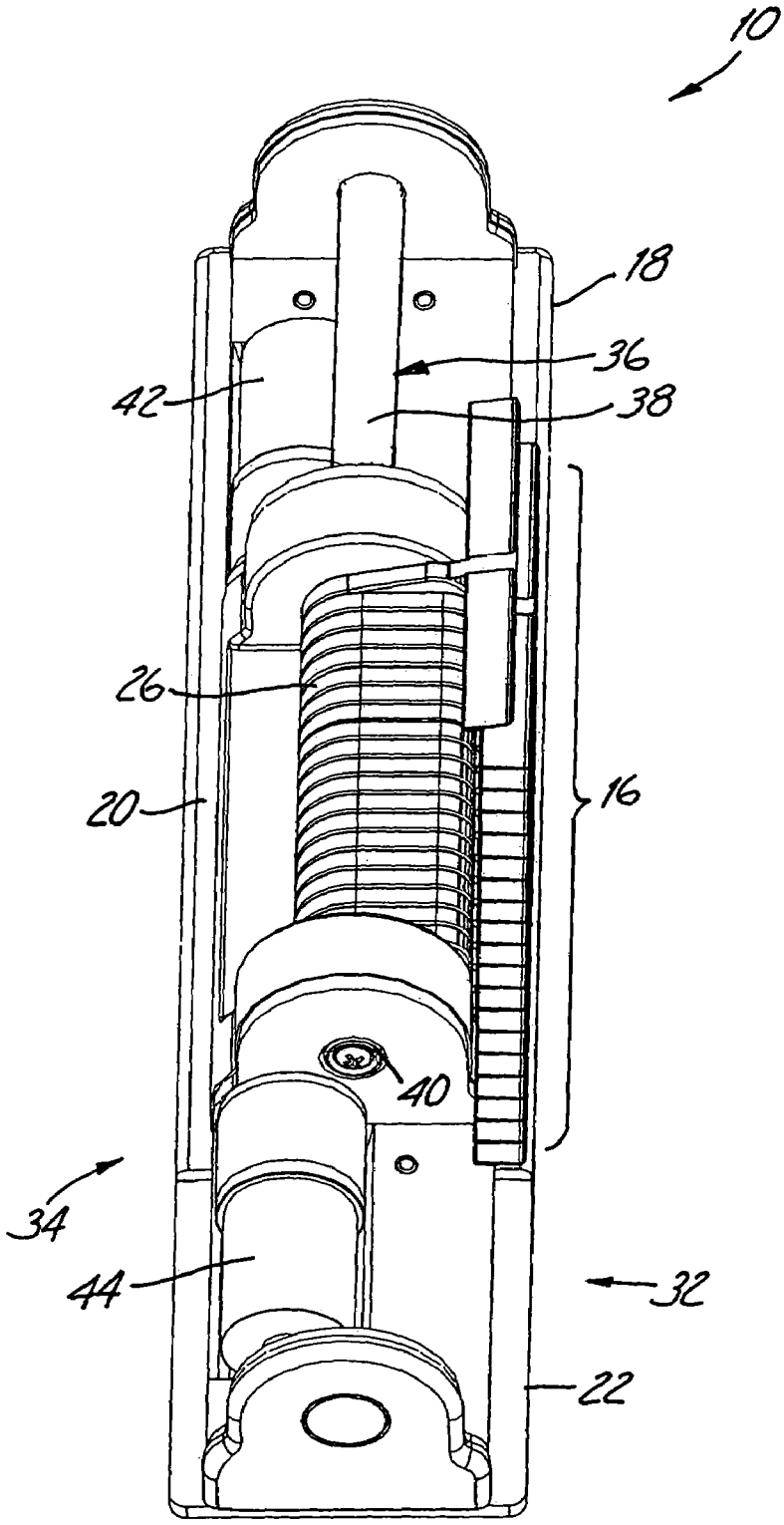
FIG. 3 is a front view of the motorized page turning device of the present invention with covers of a top and bottom housing removed.

FIG. 3 is a front perspective view of page turning device 10 with covers of top and bottom housings 18 and 22 removed. A shaft 36 having a main shaft 38 and a linear drive sleeve 40 is mounted within top, center, and bottom housing 18, 20, and 22. Main shaft 38 is disposed within top housing 18 and is operatively connected to a first motor 42, also housed within top housing 18, which rotates main shaft. Linear drive sleeve 40 of shaft 36 is disposed within bottom housing 22 and is operatively connected to a second motor 44, also housed in bottom housing 22, which axially advances linear drive sleeve 40. Shuttle assembly 16 is rotatably connected to shaft 36 at center housing 20.

Page turning device 10 turns pages by positioning shuttle assembly 16 at first side 32 of page turning device 10. Single pieces of paper are then attached to as many clips 28 as there are pieces of paper starting from the topmost shuttle to the bottommost shuttle of shuttle assembly 16. Main shaft 38 selectively engages the topmost shuttle of shuttle assembly 16 and first motor 42 rotates main shaft 38 from first side 32 of page turning device 10 to second side 34 of page turning device 10. After a pre-set time delay or actuation by the musician, second motor 44 axially advances linear drive sleeve 40 of shaft 36 downward until shaft 36 selectively engages the next shuttle in shuttle assembly 16. This procedure continues until all shuttles 26 and clips 28 of shuttle assembly 16 are positioned on second side 34 of motorized page turning device 10.

Figure 4:
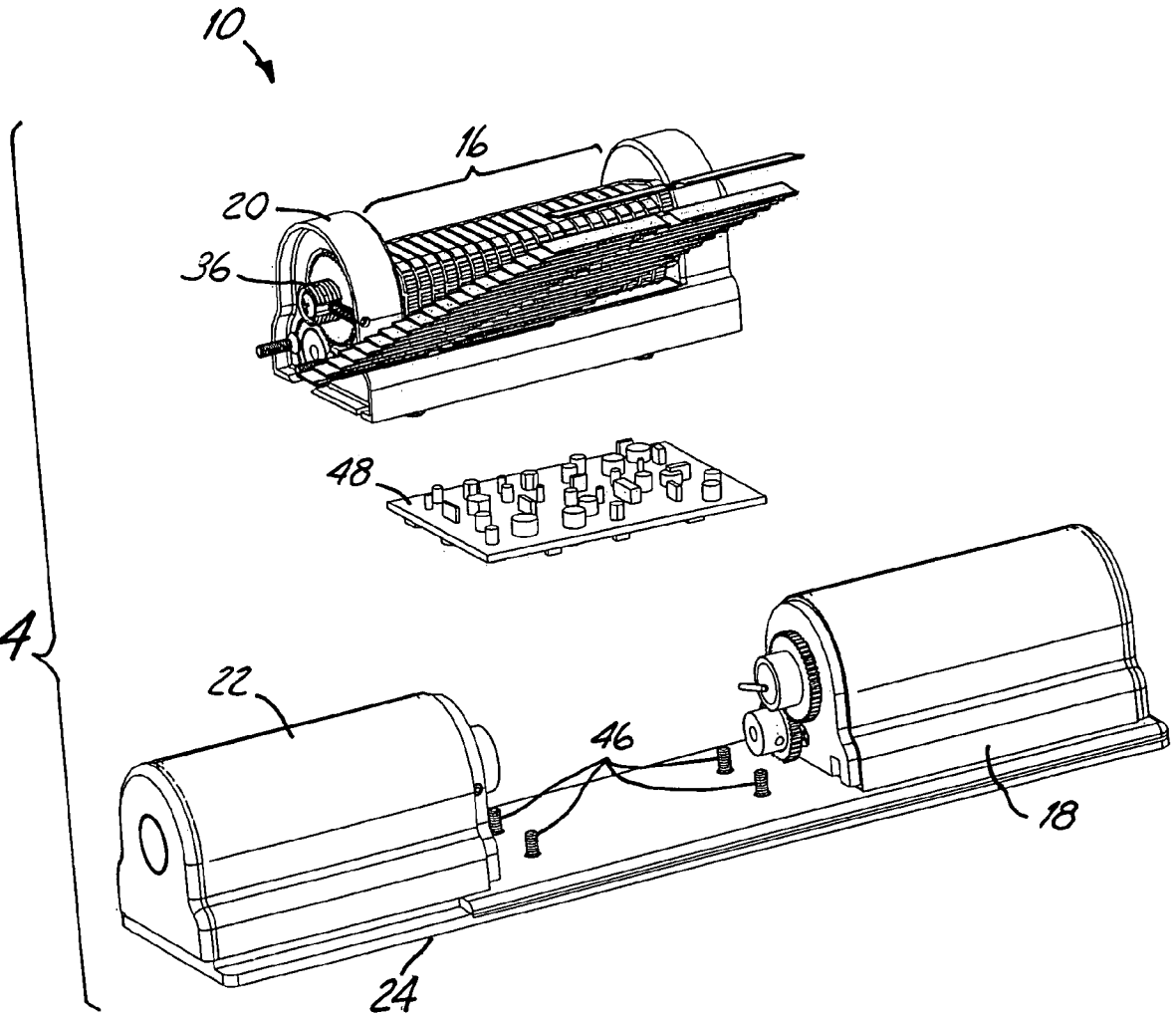
FIG. 4 is a partially exploded view of the motorized page turning device of the present invention

FIG. 4 is a partially exploded view of page turning device 10. Top, center, and bottom housings 18, 20, and 22 of page turning device 10 are held in alignment by backplate 24 and are secured to backplate 24 by screws 46. Backplate 24 has a length approximating the lengths of top, center, and bottom housings 18, 20, and 22 combined. As can be seen in FIG. 4, page turning device 10 includes a logic circuit 48 located between center housing 20 and backplate 24. Logic circuit 48 is operatively connected to shaft 36 and shuttle assembly 16 and senses and controls axial and rotational movement of shaft 36.

Figure 5:
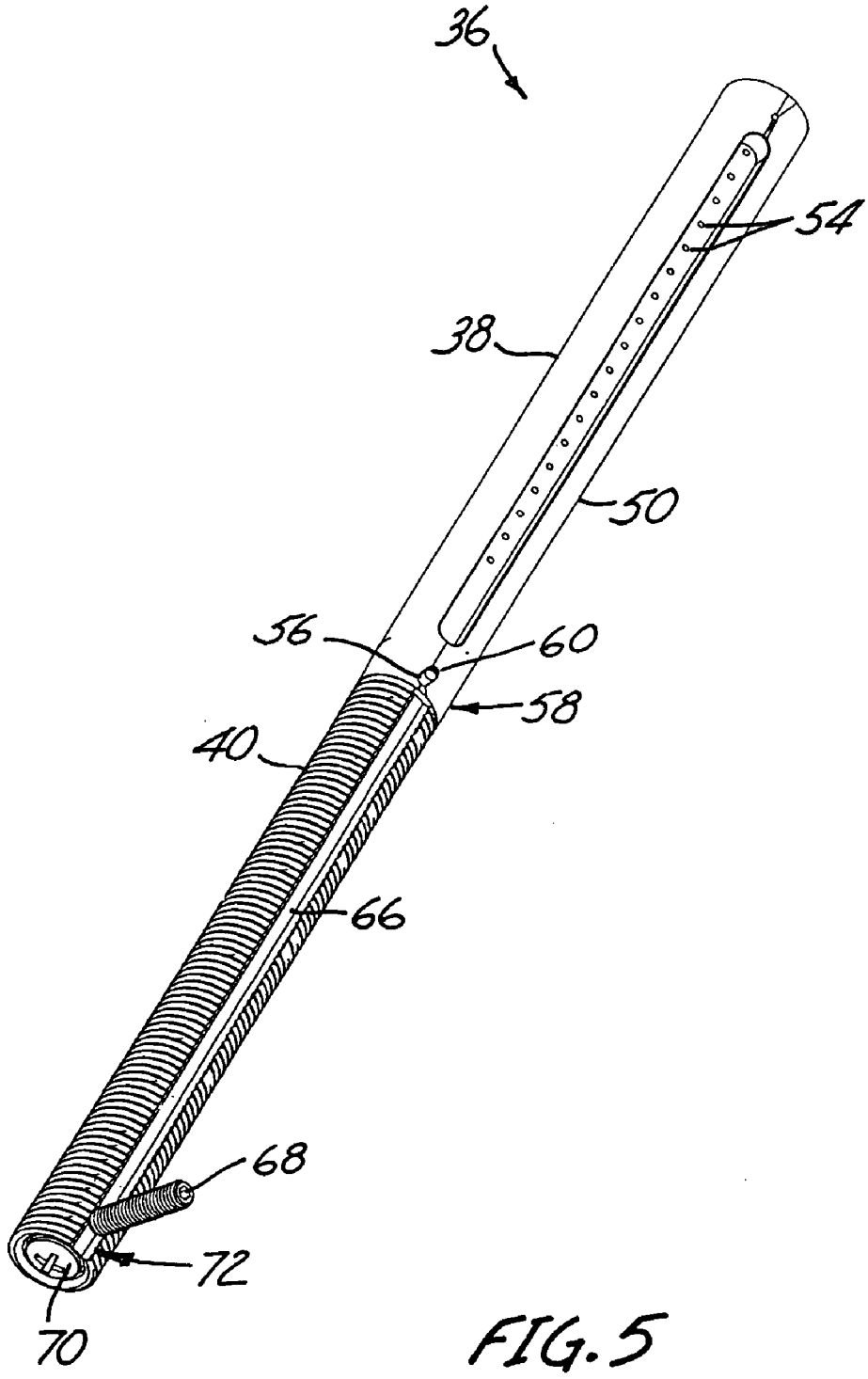
FIG. 5 is an enlarged view of a shaft of the motorized page turning device of the present invention in a first position.
Figure 5A:
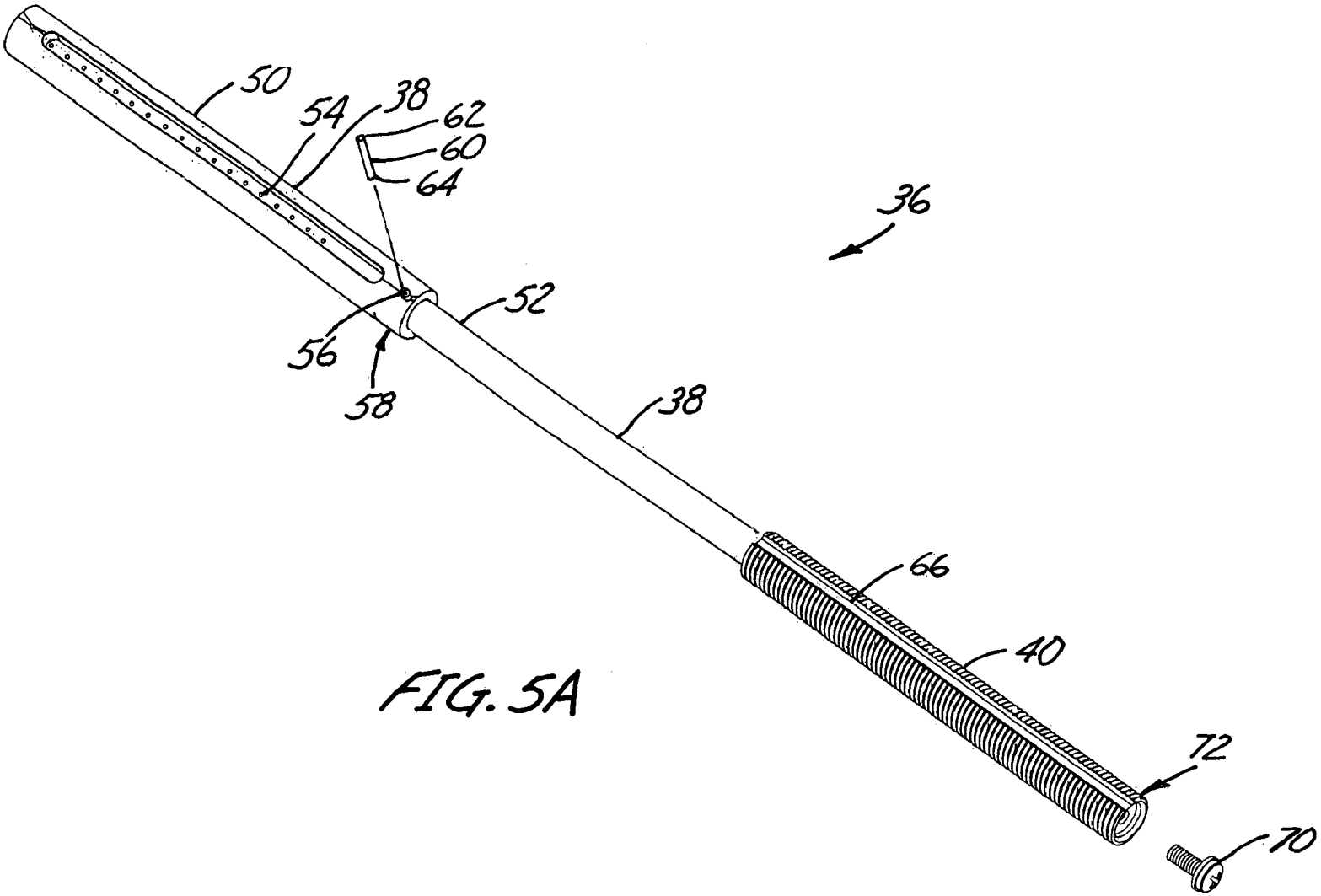
FIG. 5A is an enlarged view of the shaft of the motorized page turning device of the present invention in a second position.

FIGS. 5 and 5A are enlarged views of shaft 36 and will be discussed in conjunction with one another. Shaft 36 serves to rotate shuttle assembly 16 from first side 32 of page turning device 10 to second side 34 of page turning device 10 (not shown in FIG. 5 or 5A). In a preferred embodiment, shaft 36 is a slip fit shaft wherein main shaft 38 comprises an upper portion 50 and a lower portion 52 with lower portion 52 of main shaft 36 disposed within linear drive sleeve 40 of shaft 36. This configuration allows linear drive sleeve 40 to remain stationary relative to main shaft 38 when main shaft 38 rotates. As first motor 42 (shown in FIG. 3) rotates main shaft 38, lower portion 52 of main shaft 38 rotates within linear drive sleeve 40 in cycles of approximately 180 degrees as linear drive sleeve 40 remains fixed. At the completion of each rotation cycle of main shaft 38 within linear drive sleeve 40, linear drive sleeve 40 axially advances shaft 36 after a pre-set time delay or actuation by the user.

Upper portion 50 of main shaft 38 comprises a plurality of holes 54 spanning the length of upper portion 50 and extending through main shaft 38 for sensing axial movement of main shaft 38 via a photo eye assembly. A bore 56 running parallel to holes 54 extends through shaft 36 at a bottom end 58 of upper portion 50 of main shaft 38 and is sized to accept a drive pin 60. Drive pin 60 has a diameter such that drive pin 60 is frictionally held in bore 56 and a length such that drive pin 60 passes through bore 56 with first and second opposing ends 62 and 64 of drive pin 60 protruding from upper portion 50.

Linear drive sleeve 40 is threaded and acts as a jackscrew to axially advance shaft 36. Keyway 66 runs the length of linear drive sleeve 40 and holds linear drive sleeve 40 in place in conjunction with screw 68 which mates with keyway 66 and prevents linear drive sleeve 40 from rotating when main shaft 38 rotates or when second motor 44 (shown in FIG. 3), which is operatively connected to linear drive sleeve 40, rotates. This prevents shaft 36 from entering into a "thread lock-up". Because keyway 66 and screw 68 prevent linear drive sleeve 40 from rotating, when second motor 44 rotates, the threads of linear drive sleeve 40 drives linear drive sleeve 40 in a linear, rather than rotational, direction. Linear drive sleeve 40 also comprises a retainer screw 70 located at a bottom end 72 of linear drive sleeve 40 which aids in keeping linear drive sleeve 40 connected to main shaft 38.

Figure 6:
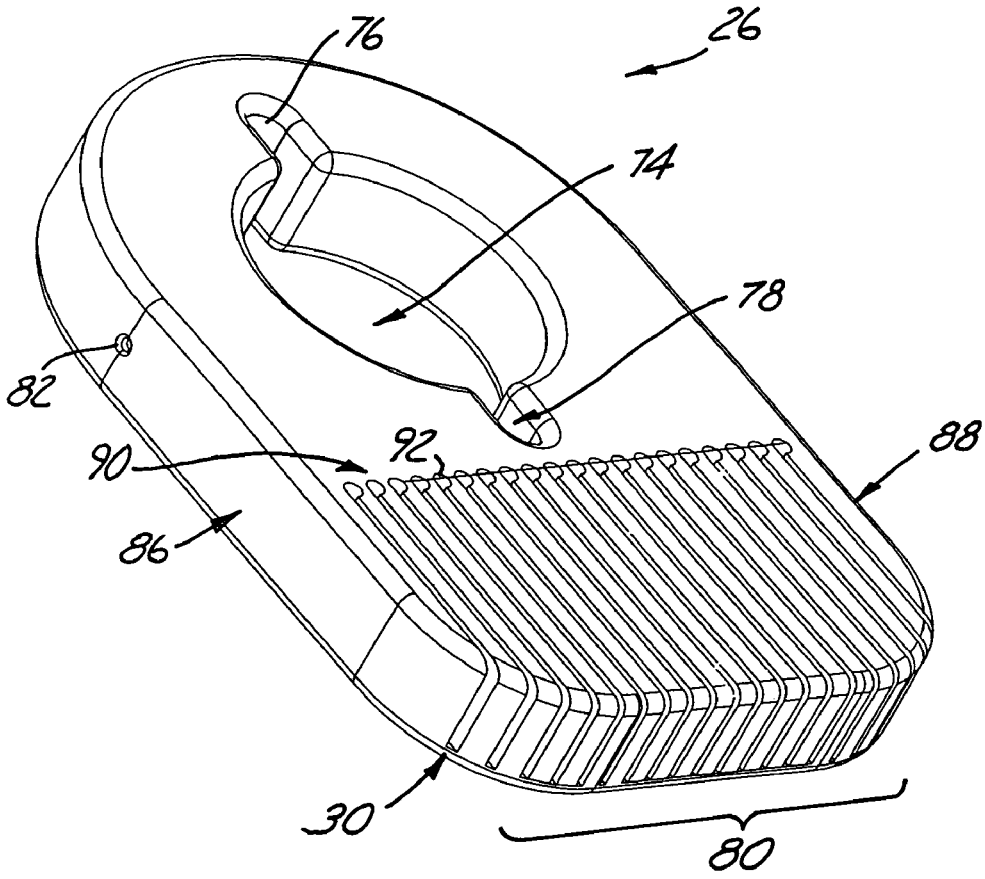
FIG. 6 is an enlarged top perspective view of a shuttle of the motorized page turning device of the present invention.

FIG. 6 shows an enlarged top perspective view of one of shuttles 26 of motorized page turning device 10. Please note that the discussion of FIGS. 6 and 6A extend to all shuttles 26. Shuttle 26 generally comprises a bore 74 sized to accept shaft 36 (not shown in FIG. 6), first and second notches 76 and 78 located at opposing sides of bore 74, a plurality of linear slots 80 spanning first side 30 of shuttle 26, and a detent 82 and 84 on a second and third side 86 and 88, respectively, of shuttle 26. First and second notches 76 and 78 extend from bore 74 in the same plane as linear slots 80 and are sized to mate with first and second ends 62 and 64 of drive pin 60 (not shown in FIG. 6).

Linear slots 80 span along first side 30 of shuttle 26 and extend from an interior end 90 of shuttle 26 to first side 30 of shuttle 26. Each linear slot 80 is capable of securing an attachment means to shuttle 26 and has a hole 92 at interior end 90 for locking the attachment means to shuttle 26. Each page connected to motorized page turning device 10 is attached to and turned by one of shuttles 26 by the attachment means connected at one of linear slots 80.

Figure 6A:
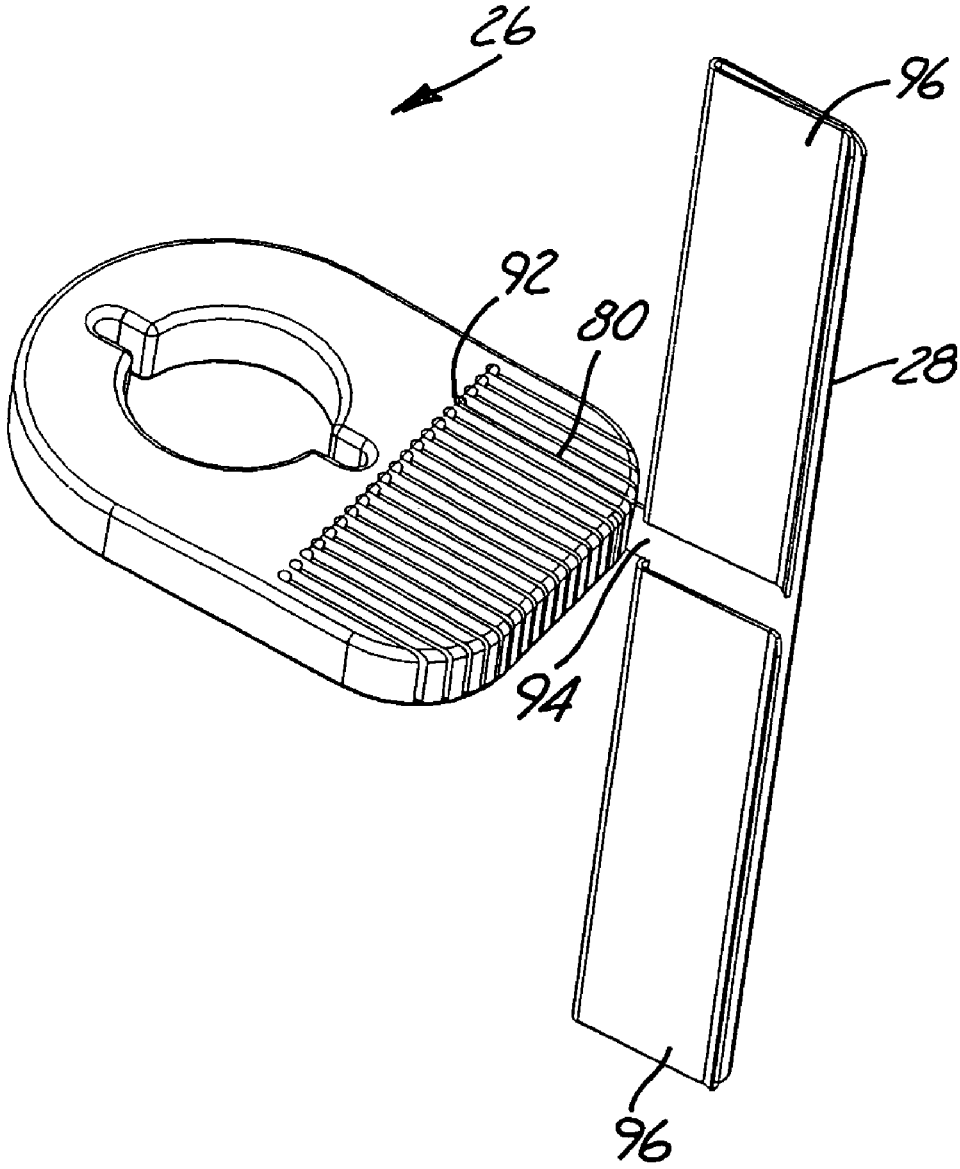
FIG. 6A is an angled perspective view oaf clip attached to the shuttle of FIG. 3 of the motorized page turning device of the present invention.

FIG. 6A depicts an attachment means connected to shuttle 26. Page turning device 10 (not shown in FIG. 6A) includes attachment means for connecting a piece of paper to shuttle 26, which in one embodiment comprises clip 28. Other attachment means can be used without departing from the intended scope of the invention, as will be evident to those skilled in the art. Clip 28 generally comprises a flat linear extension 94 and at least one clip member 96 extending normally from flat linear extension 94. In a preferred embodiment, clip 28 comprises two clip members 96.

Clip 28 connects to shuttle 26 by flat linear extension 94 which mates with one of linear slots 80 of shuttle 26 and is locked in place by hole 92 of linear slot 80. A single page or sheet of paper attaches to clip 28 by sliding the page between clip members 96. As shuttle 26 rotates with shaft 36, the page attached to clip 28 is turned from first side 32 of page turning device 10 to second side 34 of page turning device 10 (as shown in FIG. 2).

Figure 7:
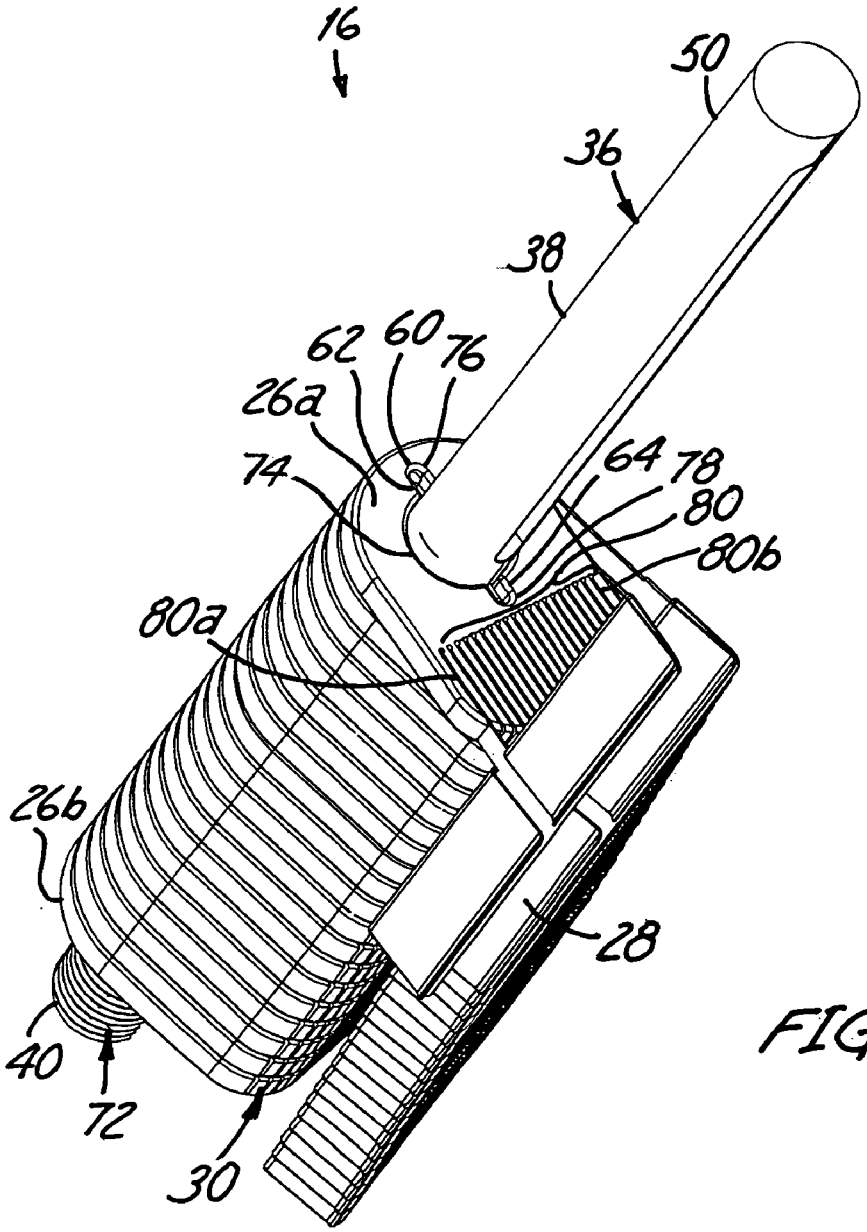
FIG. 7 is an angled top perspective view of a shuttle assembly and clips rotatably connected to the shaft of the present invention.

FIG. 7 shows shuttle assembly 16 in the first position stacked at linear drive sleeve 40. In a preferred embodiment, shuttle assembly 16 comprises twenty shuttles 26, with first shuttle 26*a* located at the top of shuttle assembly 16 and twentieth shuttle 26*b* located at the bottom of shuttle assembly 16. Each shuttle 26 comprises twenty linear slots 80, with first linear slot 80*a* located at one end of first side 30 of shuttle 26 and twentieth linear slot 80*b* located at the opposite end of first side 30 of shuttle 26. While each shuttle 26 comprises twenty linear slots 80, each shuttle 26 comprises only one clip 28 mated to one of linear slots 80. No two clips 26 attached to shuttle assembly 16 mate with the same linear slot 80 of any two shuttles 26. Progressing from shuttle 26*a*, which is in closest proximity to upper portion 50 of main shaft 38, to shuttle 26*b*, which is in closest proximity to bottom end 72 of linear drive sleeve 40, clips 28 mate with linear slots 80 sequentially. For example, clip 28 of first shuttle 26*a* mates with first linear slot 80*a* of first shuttle 26*a* and clip 28 of twentieth shuttle 26*b* which mates with twentieth linear slot 80*b* of twentieth shuttle 26*b*.

Shuttles 26 are rotatably connected to shaft 36 by aligning notches 76 and 78 of shuttles 26 with drive pin 60 protruding from upper portion 50 of main shaft 38 and passing shaft 36 through bores 74 of shuttles 26 such that first shuttle 26*a* is at one end of shuttle assembly 16 and twentieth shuttle 26*t* is at the opposing end of shuttle assembly 16. When shuttle assembly 16 is in the first position, shuttles 26 are positioned on shaft 36 such that first side 30 of shuttles 26 and clips 28 are located at first side 32 of page turning device 10 (not shown in FIG. 7) and drive pin 60 is mated with notches 76 and 78 of first shuttle 26*a*. As first and second ends 62 and 64 of drive pin 60 mate with notches 76 and 78 of only one shuttle 26 when shaft 36 is at any given linear position, shuttles 26 are individually rotated from first side 32 to second side 34 of page turning device 10 by drive pin 60 in sequential order from the top shuttle to the bottom shuttle. Although FIG. 7 depicts a drive pin and notch mechanism for selectively rotating the shuttles from the first side to the second side of the page turning device, other mechanisms may be used to rotate the shuttles without departing from the intended scope of the invention, as will be evident to those skilled in the art. For example, the shuttles may be selectively rotated by a key on the shaft, a tab in the bore of the shuttles, a detent and spring loaded ball mechanism, or any other mechanism including a protrusion configured to enable the shaft to selectively engage a specific shuttle.

Figure 8:
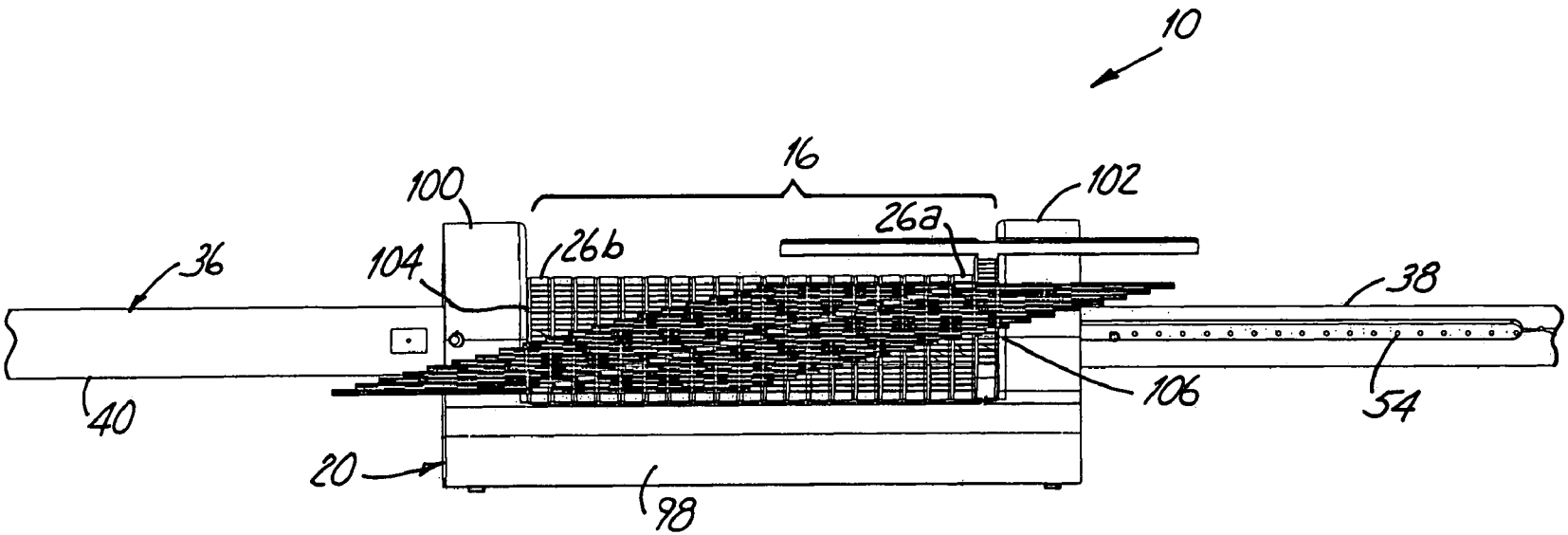
FIG. 8 is a side view of the shaft and shuttle assembly housed within a center housing of the motorized page turning device of the present invention.

FIG. 8 is a side view of shaft 36 and shuttle assembly 16 housed within center housing 20 of page turning device 10. Center housing 20 comprises generally base 98, first and second ends 100 and 102 extending in the same direction normally from base 98, and first and second openings 104 and 106 sized to accept shaft 36 located at first and second ends 100 and 102 of center housing 20, respectively. Shaft 36, shuttle assembly 16, and shuttle lock 108 (shown in detail in FIG. 8B) are housed within center housing 20 between first and second ends 100 and 102.

To assemble shuttle assembly 16 onto shaft 36 and within center housing 20, main shaft 38 is first passed through first opening 104 in first end 100 of center housing 20. Main shaft 38 is then passed through bores 74 of shuttles 26. Because shuttle assembly 16 is positioned on shaft 36 such that shuttle 26*a* is in closest proximity to main shaft 38, and twentieth shuttle 26*b* is in closest proximity to linear drive sleeve 40, the first shuttle 26 slid onto shaft 36 is twentieth shuttle 26*b*, and the last shuttle slid onto shaft 36 is first shuttle 26*a*.

Figure 8A:
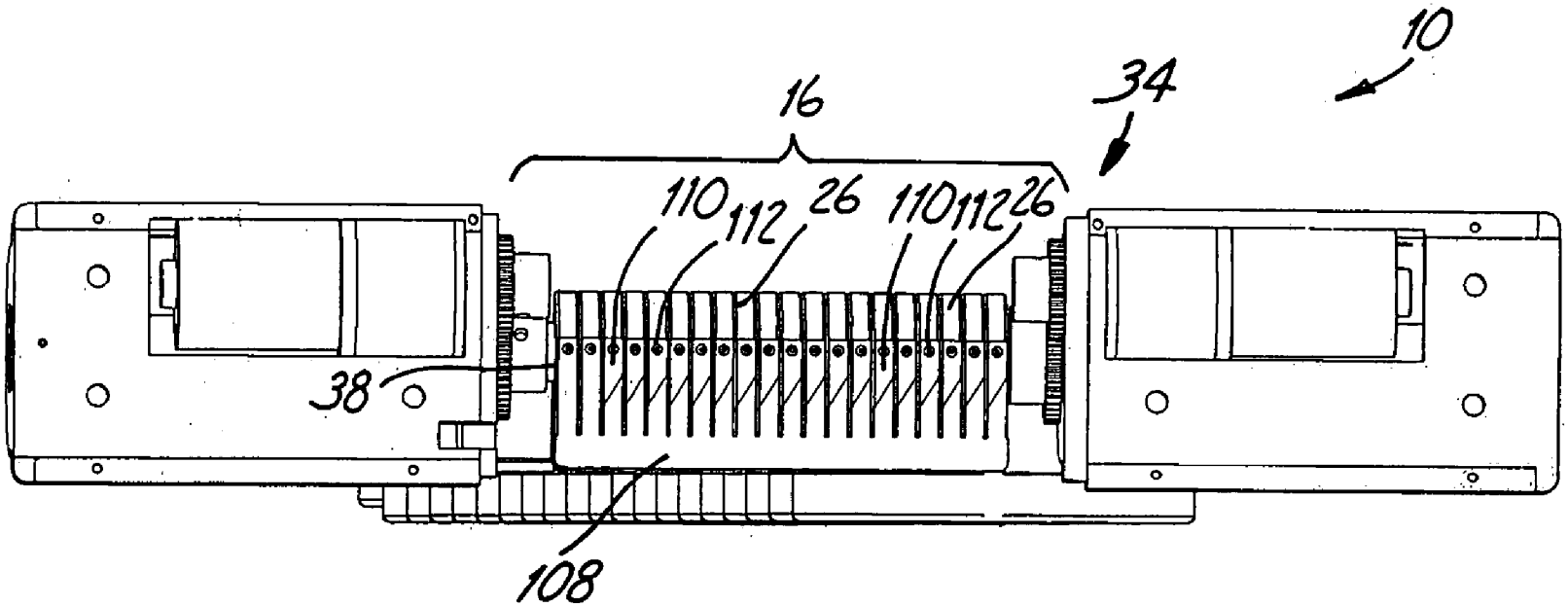
FIG. 8A is a side view of a shuttle lock engaging the shuttle assembly of the motorized page turning device of the present invention.
Figure 8B:
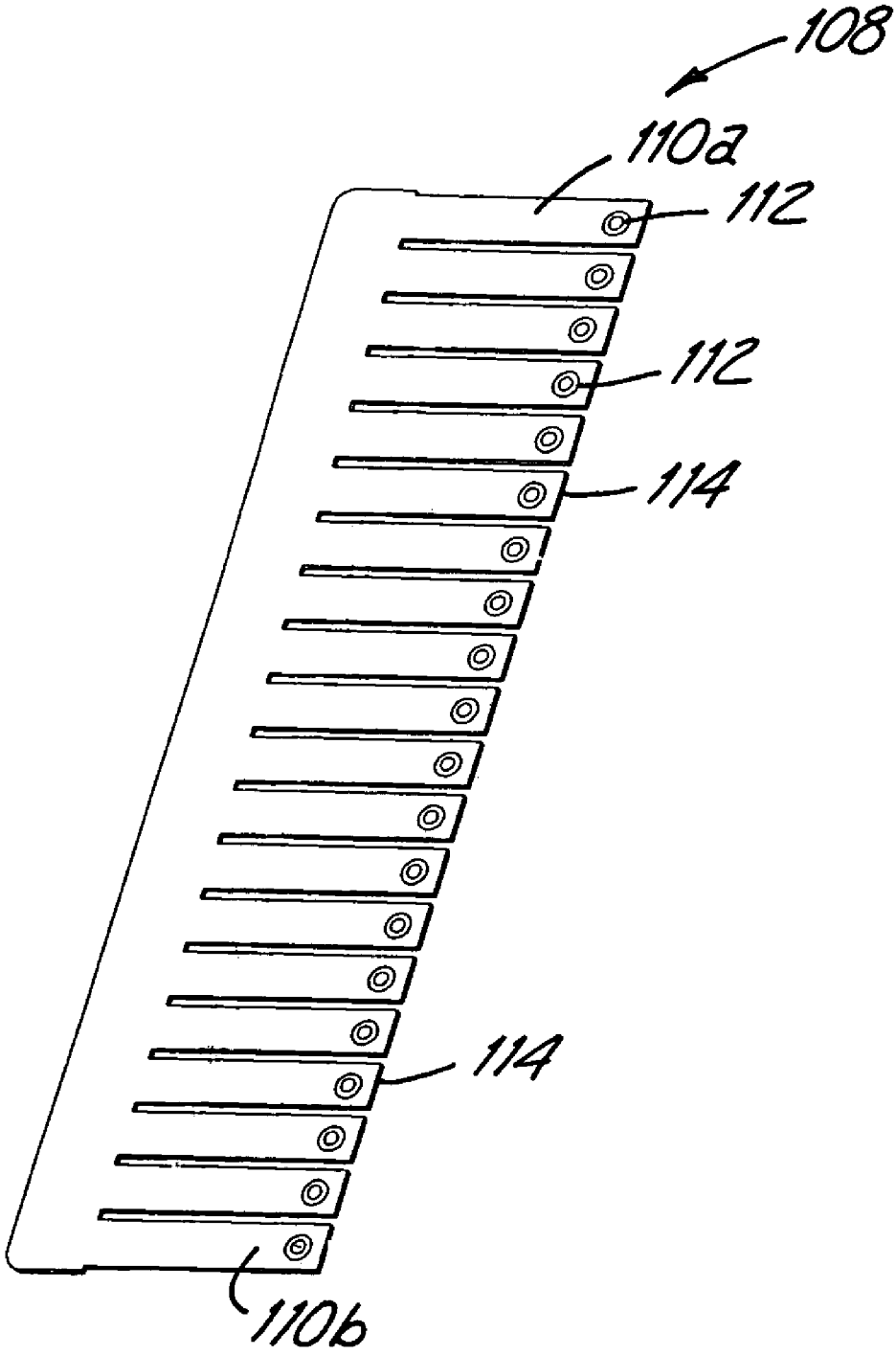
FIG. 8B is a front view of a shuttle lock of the motorized page turning device of the present invention.

To align shuttles 26, shuttle lock 108, as shown and described in FIG. 8B, is placed in contact with shuttle assembly 16. To better illustrate the placement and function of shuttle lock 108, FIG. 8A is a rear view of page turning device 10 with center housing 20 removed and will be discussed in conjunction with FIG. 8. Shuttle lock 108 abuts shuttle assembly 16 and is positioned so that flexible arms 110 point toward second side 34 of page turning device 10. Shuttles 26 are then adjusted until detent 82 of second side 86 of shuttles 26 (as shown in FIG. 6) mate with bumps 112 of flexible arms 110 of shuttle lock 108.

Once shuttles 26 are aligned with each other and in place, main shaft 38 is passed through second opening 106 in second end 102 of center housing 20. When shaft 36 is in final position, lower portion 52 of main shaft 38 is fully disposed within linear drive sleeve 40 and upper portion 50 of main shaft 38 protrudes from second opening 106 of center housing 20 such that holes 54 of upper portion 50 of main shaft 38 extend past center housing 20. Linear drive sleeve 40 protrudes from first opening 104 of center housing 20 such that bottom end 72 of linear drive sleeve 40 extends past center housing 20.

FIG. 8B is an enlarged view of shuttle lock 108. Shuttle lock 108 abuts shuttle assembly 16 at second side 86 of shuttles 26 (as shown in FIG. 8A) and maintains shuttles 26 in alignment with one another. Shuttle lock 108 has a length equal to the length of shuttle assembly 16 and generally comprises a plurality of flexible spring arms 110 spanning the length of shuttle lock 108. Shuttle lock 108 comprises as many flexible spring arms 110 as there are shuttles 26 in shuttle assembly 16. In a preferred embodiment, shuttle lock 108 comprises twenty flexible spring arms 110, with first flexible arm 110*a* located at a first end of shuttle lock 108 and twentieth flexible arm 110*b* located at an opposing end of shuttle lock 108. Each of arms 110 is aligned with a respective shuttle 26 and has a width approximately equal to the width of one of shuttles 26. For example, first shuttle 26*a* is aligned with first arm 110*a* and twentieth shuttle 26*b* is aligned with twentieth arm 110*b*.

A bump 112 is located at an end 114 of each of arms 110 and mates with either detent 82 or 84 of respective shuttle 26. In the first position, bump 112 of each of arms 110 engages detent 82 on second side 86 of shuttles 26. As each shuttle 26 rotates with main shaft 38, respective arm 110 bends in order to give shuttle 26 enough release to rotate. In one embodiment, shuttle lock 108 is made of spring steel or plastic to provide a slight spring pressure to keep bumps 112 engaged with either detent 82 or 84 of shuttles 26. Each shuttle 26 has completed its rotation with main shaft 38 and is in the second position when detent 84 on third side 88 of shuttle 26 engages bump 112 of shuttle lock 108.

Figure 9:
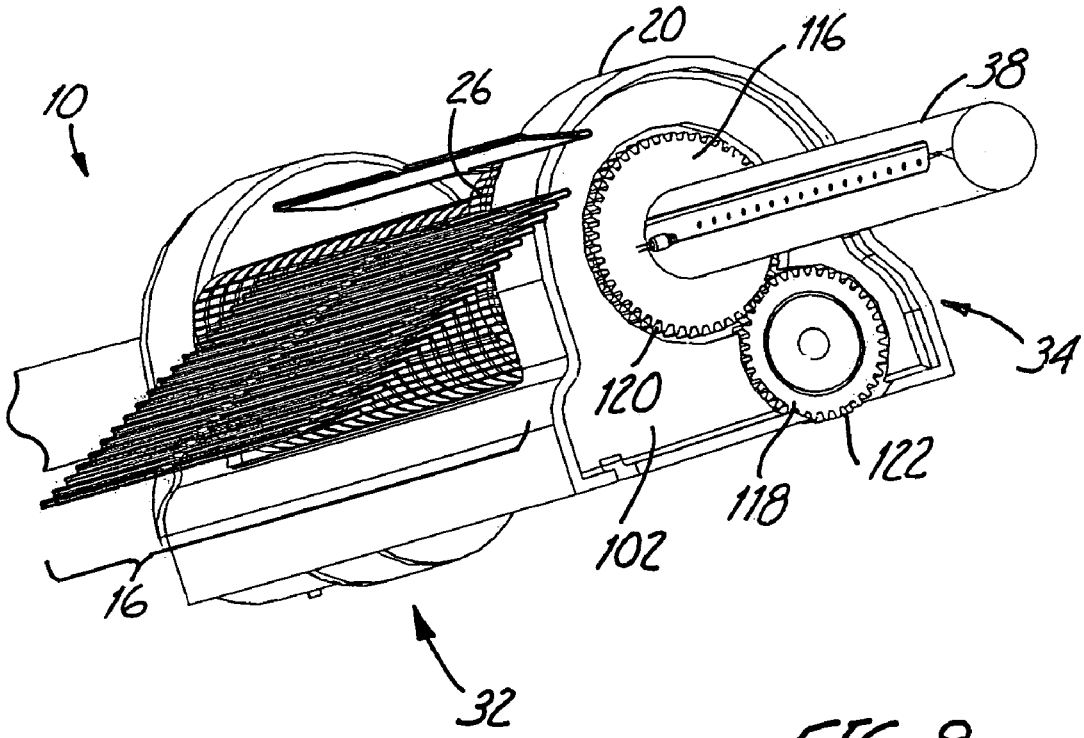
FIG. 9 is a side perspective view of a second side of the center housing showing a first and second gear of the motorized page turning device of the present invention.

FIG. 9 shows (upper) second end 102 of center housing 20 with first and second gears 116 and 118. Gears 116 and 118 are embedded in second end 102 of center housing 20 and are used to rotate main shaft 38. Gears 116 and 118 are positioned in close proximity to one another such that teeth 120 of first gear 116 engage teeth 122 of second gear 118. Due to the interaction between teeth 120 and 122 of first and second gears 116 and 118, when second gear 118 is rotated, second gear 118 causes first gear 116 to also rotate. As main shaft 38 is affixed to first gear 116, main shaft 38 rotates with first gear 116. Likewise, because shuttle assembly 16 is rotatably connected to main shaft 38, when main shaft 38 rotates from first side 32 to second side 34 of page turning device 10, shuttle 26 mated with drive pin 60 also rotates from first side 32 of page turning device 10 to second side 34 of page turning device 10.

FIGS. 10, 11, 12, and 13 show top housing 18 of page turning device 10 of the present invention and will be discussed in conjunction with one another. Top housing 18 comprises generally base 124, first and second ends 126 and 128 extending normally in the same direction from base 124, opening 130 in base 124, and first and second holes 132 and 134 in first end 126 of top housing 18. First motor 42, top tube 136, photo eye retainer 138, photo eye emitter 140, and photo eye receiver 142 (shown in detail in FIG. 13) are housed within top housing 18 between first and second ends 126 and 128.

Figure 10:
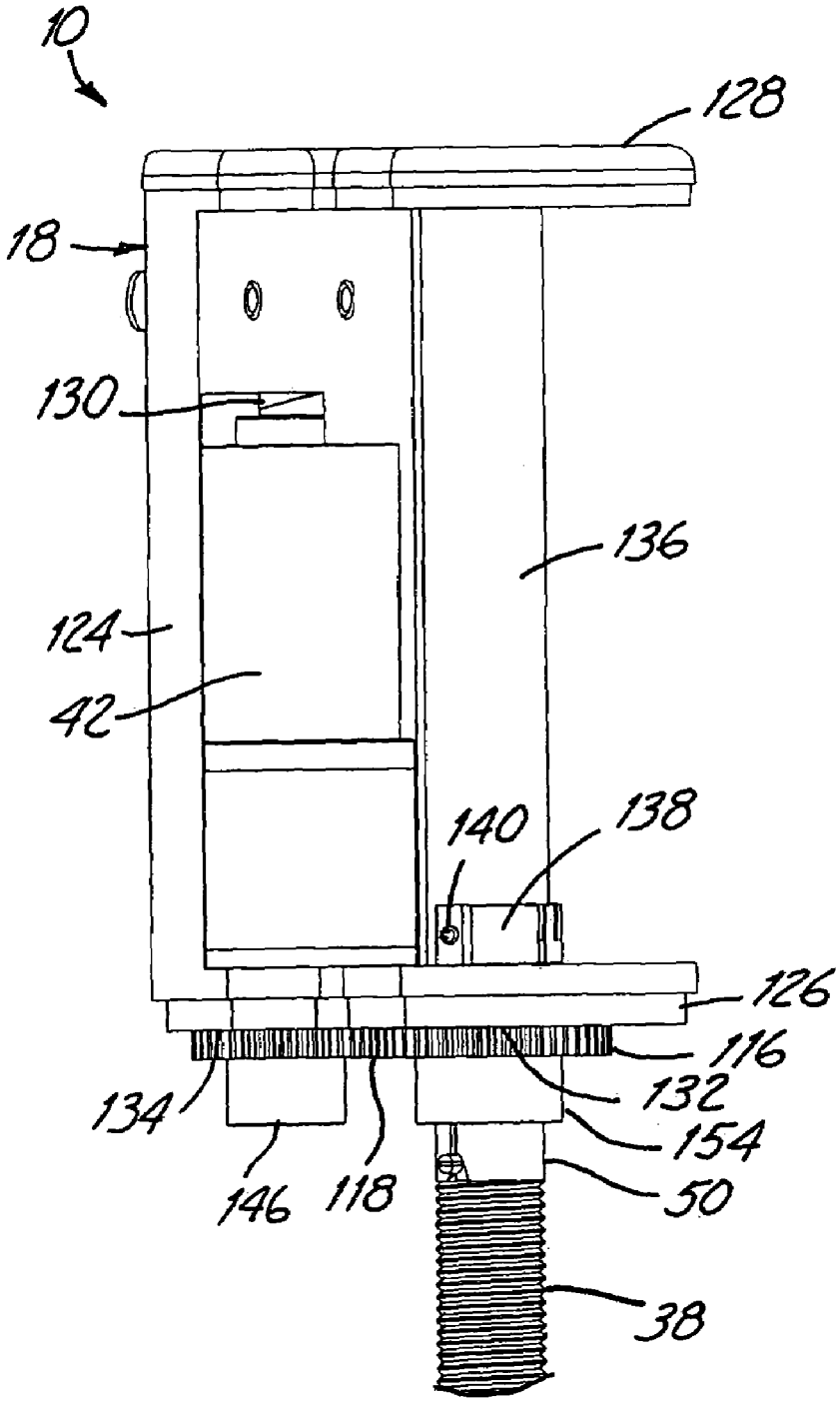
FIG. 10 is a side view of a top housing of the motorized page turning device of the present invention.
Figure 11:
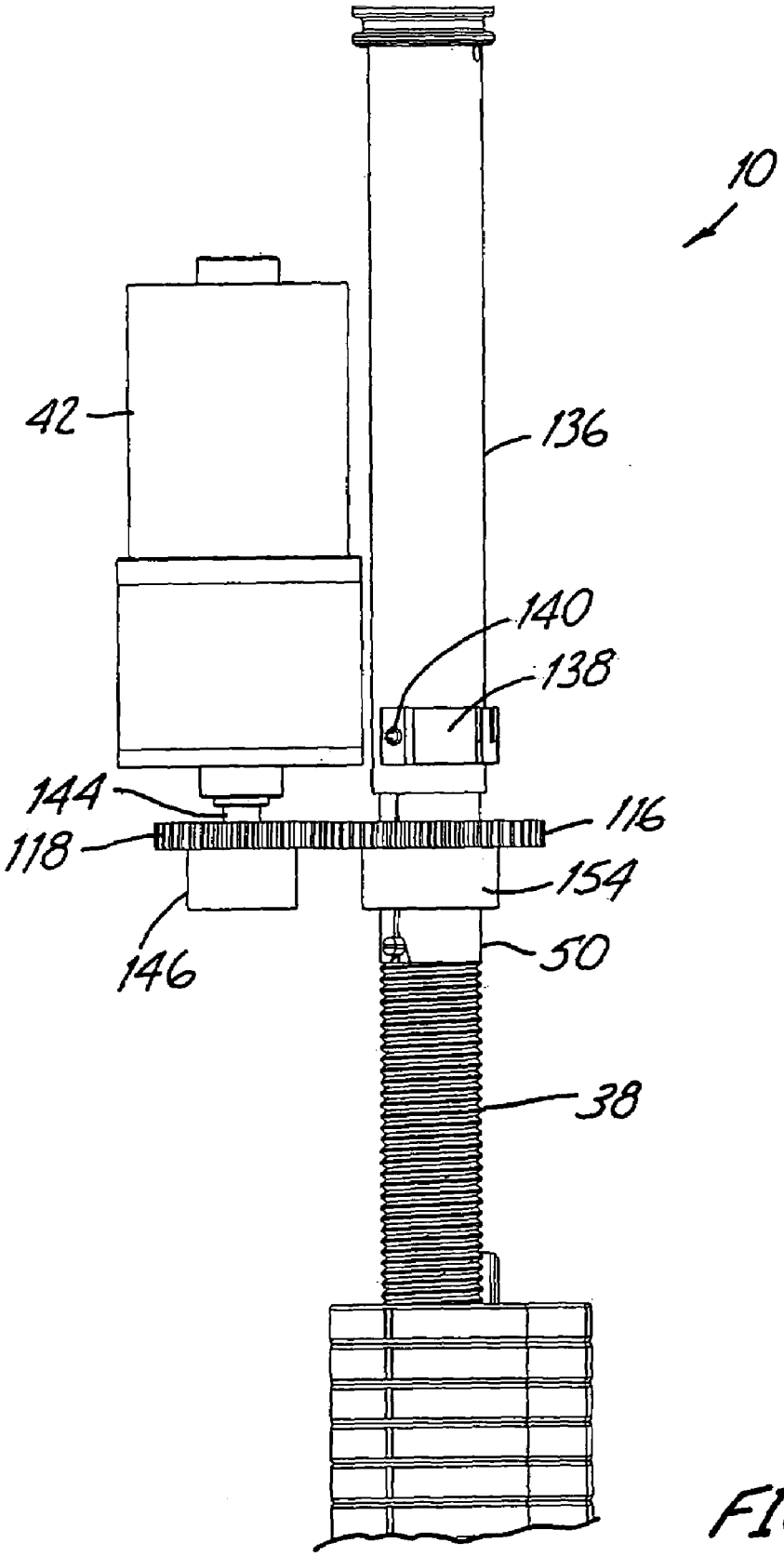
FIG. 11 is a side view of a first motor and first and second gears of the top housing of the motorized page turning device of the present invention.

FIGS. 10 and 11 show the interaction among first motor 42 and first and second gears 116 and 118. First motor 42 is positioned within opening 130 of base 124 and is operatively connected to and controls main shaft 38 by first and second gears 116 and 118. A shaft 144 protrudes slightly from first motor 42 and extends through first end 126 of top housing 18 at second hole 134 where shaft 144 securely connects to second gear 118 by pinion 146. As first motor 42 rotates, shaft 144 rotates second gear 118 in the same direction. Rotation of second gear 118 rotates main shaft 38. In a preferred embodiment, first motor 42 and gears 116 and 118 form a rotational drive.

Figure 12:
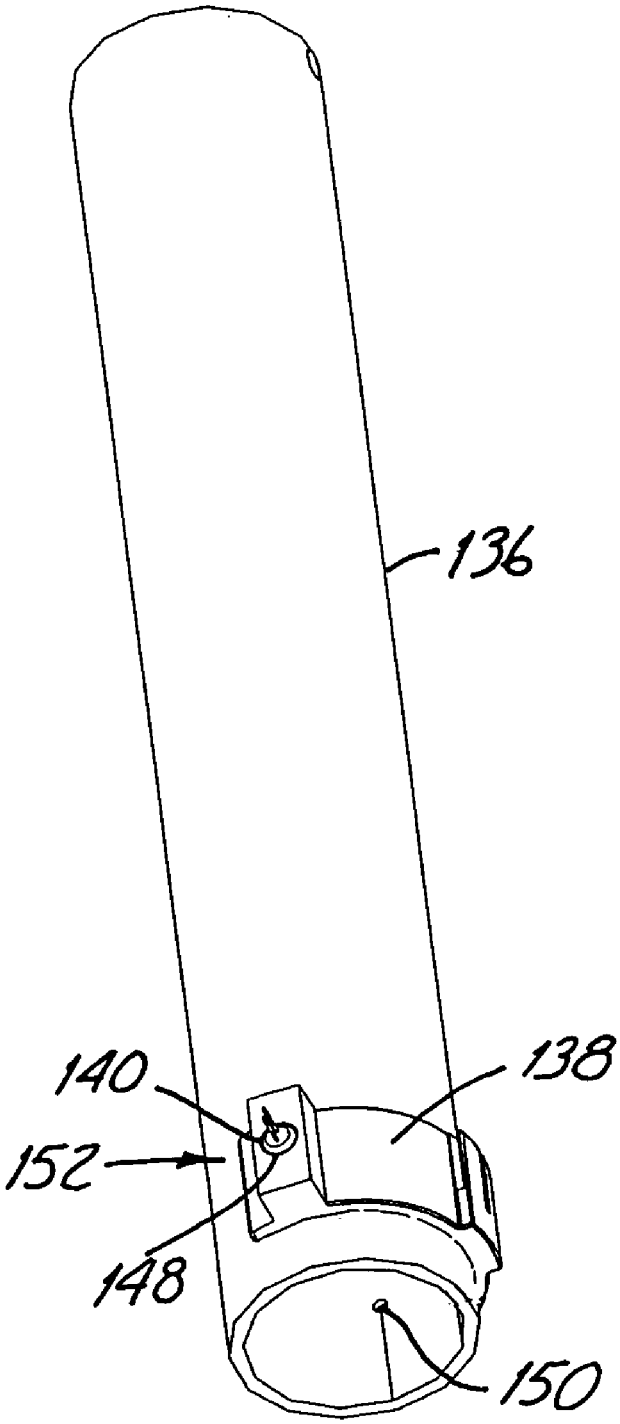
FIG. 12 is a perspective view of a top tube of the top housing of the motorized page turning device of the present invention.

As can be seen in FIG. 12, top tube 136 is an elongated tube extending the length of top base 124 and has holes 148 and 150 at a base end 152 of top tube 136, allowing photo eye emitter 140 and photo eye receiver 142 (shown in detail in FIG. 13) to communicate. Top tube 136 is positioned within top housing 18 such that base end 152 of top tube 136 is aligned with first hole 132 of top housing 18. Main shaft 38 that protrudes from second end 128 of center support 20 passes through pinion 154 and first hole 132 of top housing 18 into top tube 136 and is positioned in top tube 136 such that holes 54 (as shown in FIGS. 5 and 5A) of upper portion 50 of main shaft 38 align with holes 148 and 150 of top tube 136.

Figure 13:
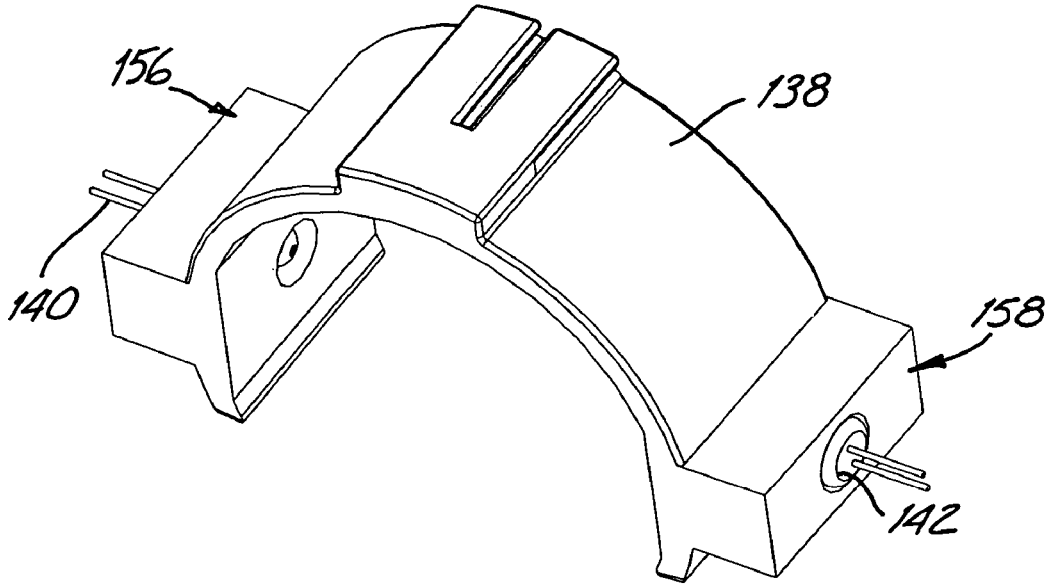
FIG. 13 is a perspective view of a photo eye retainer of the top support of the motorized page turning device of the present invention.

FIG. 13 shows an enlarged view of photo eye retainer 138. Photo eye retainer 138 is C-shaped and wraps around base end 52 of top tube 136 and holds photo eye emitter 140 and photo eye receiver 142 in alignment with one another so that photo eye emitter 140 and photo eye receiver 142 are in position to sense axial and rotational movement of shaft 36 and shuttles 26. Photo eye retainer 138 is positioned around top tube 136 such that photo eye emitter 140, photo eye receiver 142, and holes 148 and 150 of top tube 136 are aligned with one another. As main shaft 38 rotates, holes 54 of upper portion 50 of main shaft 38 also align with photo eye retainer 138 and holes 148 and 150. Photo eye emitter 140 and photo eye receiver 142 are positioned and secured in place by first and second ends 156 and 158, respectively, of C-shaped photo eye retainer 138. Photo eye retainer 138 then positions photo eye emitter 140 and photo eye receiver 142 such that photo eye emitter 140 abuts hole 148 of top tube 136 and photo eye receiver 142 abuts hole 150 of top tube 136.

Figure 14:
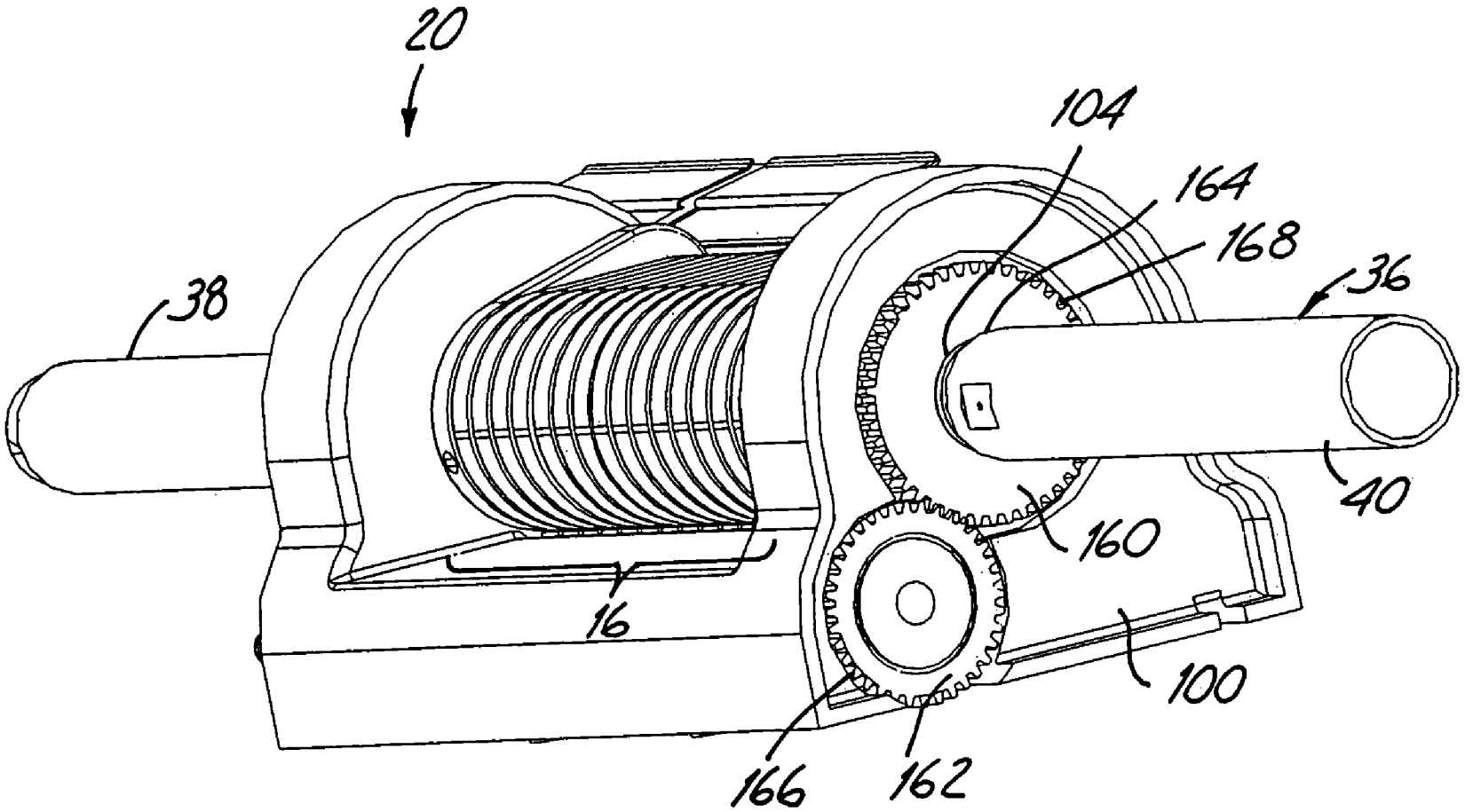
FIG. 14 is a side perspective view of a first side of the center housing showing a third and fourth gear of the motorized page turning device of the present invention.

FIG. 14 shows first (lower) end 100 of center housing 20 of page turning device 10 of the present invention. As shown in FIG. 14, center housing 20 further comprises third and fourth gears 160 and 162 embedded at first end 100 of center housing 20 which are used to rotate linear drive sleeve 40. Prior to passing main shaft 38 through first opening 104 in first end 100 of center housing 20, shaft 36 is passed through opening 164 of third gear 160. When shaft 36 is in final position within center housing 20, a portion of linear drive sleeve 40 protrudes from first opening 100 of center housing 20 such that the threads of linear drive sleeve 40 are in direct contact with internal threads of third gear 160.

Third and fourth gears 160 and 162 are positioned relative to one another such that when fourth gear 162 is rotated, teeth 166 of fourth gear 162 engages teeth 168 of third gear 160 and causes third gear 160 to rotate. As linear drive sleeve 40 is connected to third gear 160 by their respective threads, linear drive sleeve 40 is actuated when third gear 160 is rotated. Due to the external threads on linear drive sleeve 40 and the internal threads of third gear 160, as third gear 160 rotates, linear drive sleeve 40, rather than rotating, axially advances in an upward or downward direction depending on the direction fourth gear 162 is rotating. As third and fourth gears 160 and 162 rotate, linear drive sleeve 40 axially advances a distance equal to the distance between shuttles 26. Because drive pin 60 (shown in FIG. 2) is connected to shaft 36, when linear drive sleeve 40 advances to the next shuttle 26, drive pin 60 also advances to the next shuttle 26 and is in position to engage notches 76 and 78 of that shuttle 26.

Figure 15:
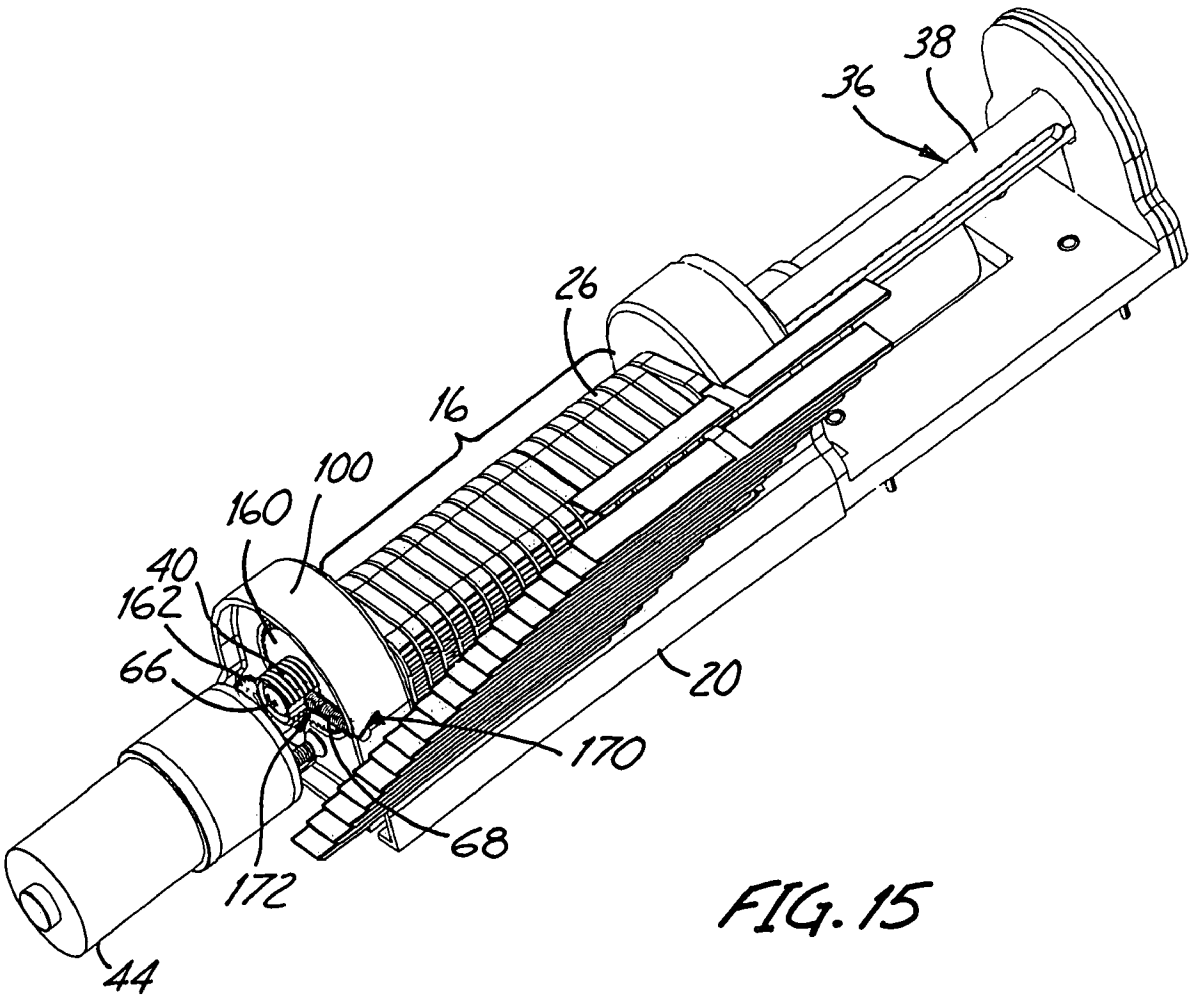
FIG. 15 is a cut-away view of a linear drive sleeve of the shaft of the motorized page turning device of the present invention.

As shown in FIG. 15, in order to prevent linear drive sleeve 40 from rotating when main shaft 38 and third gear 160 rotate, a first end 170 of screw 68 is secured to first end 100 of center housing 20 and a second, opposing end 172 of screw 68 is maintained in keyway 66. Thus, when second motor 44 causes fourth gear 162 and subsequently third gear 160 to rotate, linear drive sleeve 40 is prevented from rotating and threaded linear drive sleeve 40 axially advances shaft 36 and drive pin 60 (not shown in FIG. 15) to next shuttle 26.

Figure 16:
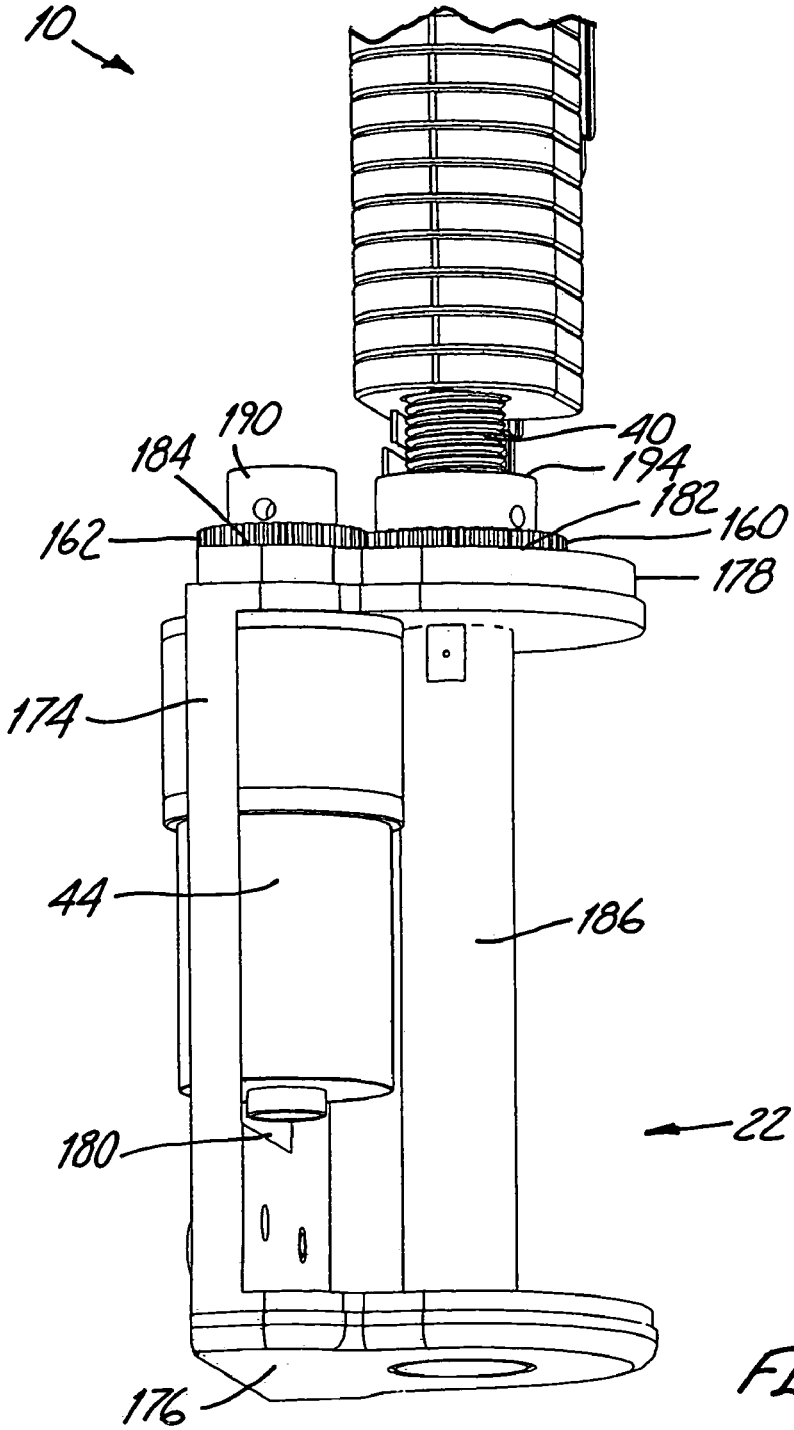
FIG. 16 is a side view of a bottom housing of the motorized page turning device of the present invention.
Figure 17:
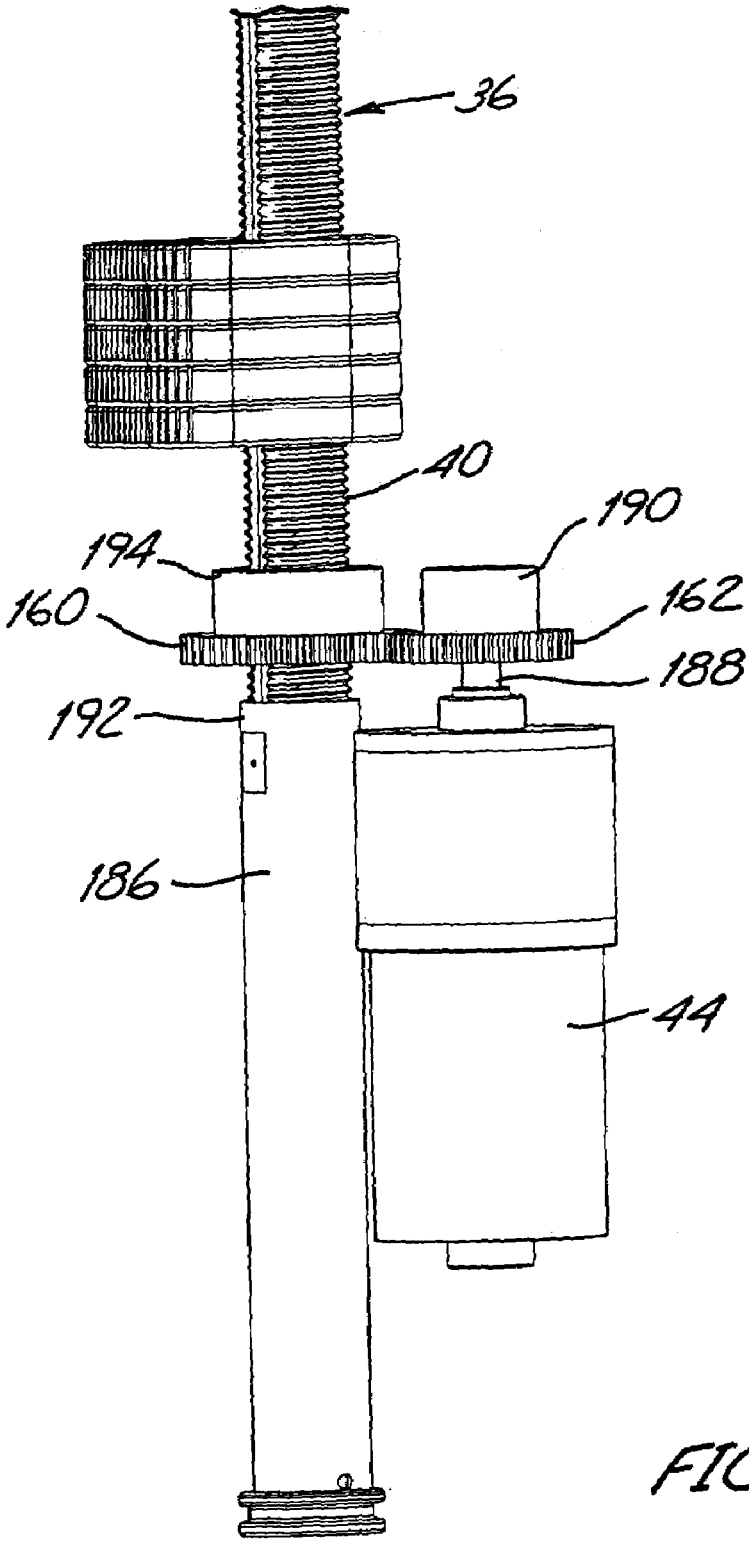
FIG. 17 is a side view of a second motor and third and fourth gears of the bottom housing of the motorized page turning device of the present invention.

FIGS. 16 and 17 show cut-away views of bottom housing 22 of page turning device 10 of the present invention and will be discussed in conjunction with one another. Bottom housing 22 generally comprises base 174, first and second ends 176 and 178 extending normally in the same direction from base 174, opening 180 in base 174, and first and second holes 182 and 184 in second end 178 of bottom housing 22. Second motor 44 and bottom tube 186 are housed within bottom housing 22 between first and second ends 176 and 178.

FIG. 17 shows the interaction among second motor 44, third gear 160, and fourth gear 162 of page turning device 10. Second motor 44 is positioned within opening 180 in base 174 of bottom housing 22 and is operatively connected to and controls linear drive sleeve 40 of shaft 36 by third and fourth gears 160 and 162. A shaft 188 protrudes slightly from second motor 44 and extends through second end 178 of bottom housing 22 at second hole 184 of bottom housing 22 where shaft 188 securely connects to fourth gear 162 by pinion 190. As second motor 44 rotates shaft 188 of second motor 44, fourth gear 162 rotates in the same direction. As previously mentioned, because third and fourth gears 160 and 162 engage, rotation of fourth gear 162 rotates third gear 160 and actuates linear drive sleeve 40. Second motor 44, in conjunction with gears 160 and 162 and linear drive sleeve 40, acts as a linear drive. Although FIG. 17 depicts the linear drive with respect to an internally threaded gear and threaded linear drive sleeve in contact with a motor pinion, the linear drive can include other mechanisms without departing from the intended scope of the invention, as will be evident to those skilled in the art. For example, the linear drive may include a rack and pinion mechanism with the pinion attached to a motor, a cable and shaft mechanism with the cable engaging a motor driven spool, a detent and ball mechanism, or a ratchet mechanism indexed by a pinion or solenoid action.

Bottom tube 186 is an elongated tube extending the length of base 174. Bottom tube 186 is positioned within bottom housing 22 such that a top end 192 of bottom tube 186 is aligned with first hole 182 of bottom housing 22. Linear drive sleeve 40 protruding from first end 100 of center housing 20 connects securely to third gear 10 by pinion 194 and passes through first hole 182 of bottom housing 22 into bottom tube 186 which supports linear drive sleeve 40.

Figure 18:
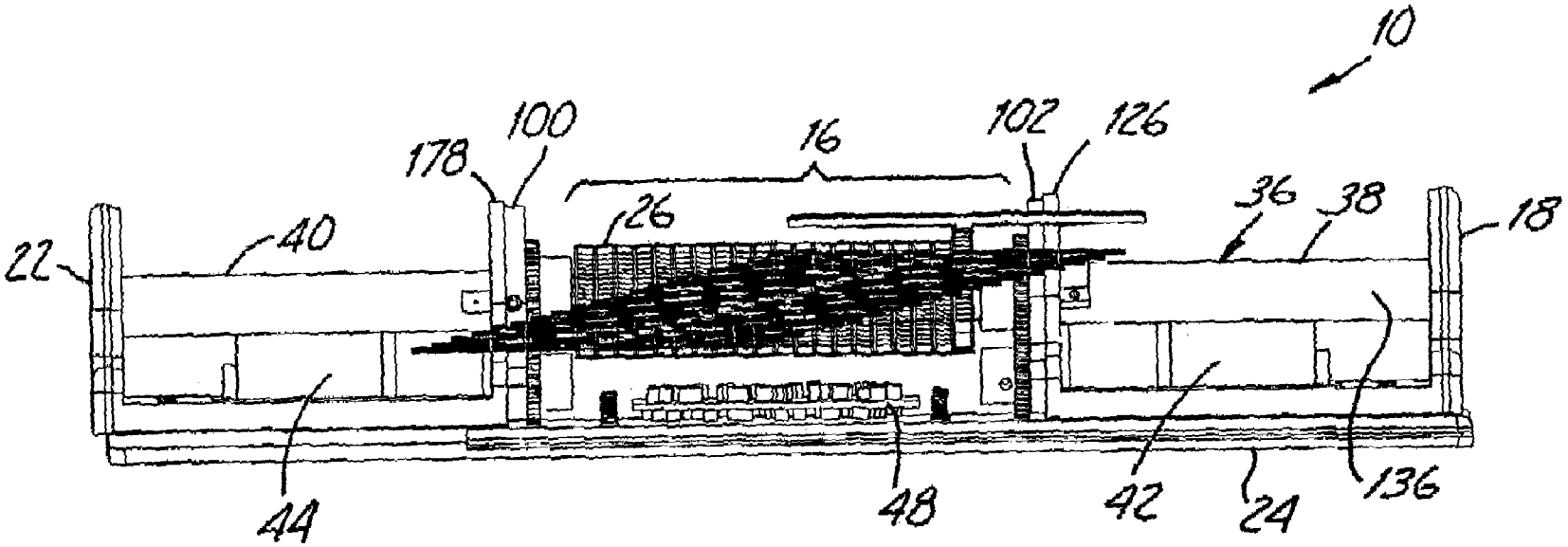
FIG. 18 is a side view of the motorized page turning device of the present invention with the center housing and covers of the top and bottom housings removed.

FIG. 18 shows page turning device 10 of the present invention with center housing 20 and covers of top and bottom housings 18 and 22, removed. Top, center, and bottom housings 18, 20, and 22 are positioned such that first end 126 of top housing 18 abuts second end 102 of center housing 20 and first end 100 of center housing 20 abuts second end 178 of bottom housing 22.

Logic circuit 48 controls and senses motion of shaft 36 and shuttles 26 and is located between base 98 of center housing 20 and backplate 24. Logic circuit 48 is operatively connected to photo eye emitter 140 and photo eye receiver 142 (shown in FIG. 13) and is triggered by infrared sensing or RF signal from the user by a mechanical switch such as a foot switch or hand triggered button. As main shaft 38 rotates in top tube 136, logic circuit 48 senses when photo eye emitter 140, photo eye receiver 142, and holes 54 of upper portion 50 of main shaft 38 are aligned, at which time main shaft 38 has finished its rotation. When logic circuit 48 senses that photo eye emitter 140, photo eye receiver 142, and holes 54 of upper portion 50 of main shaft 38 are aligned, logic circuit 48 sends a signal to first motor 42 to stop rotating.

After first motor 42 has completed its rotation cycle, main shaft 38 is positioned such that first and second ends 62 and 64 of drive pin 60 are aligned with notches 76 and 78 of shuttles 26 (not shown in FIG. 18). With drive pin 60 in line with notches 76 and 78 of shuttles 26, linear drive sleeve 40 is in position to advance to the next shuttle 26. Logic circuit 48, after a pre-set time delay or actuation by the musician after being initially triggered, sends a signal to second motor 44 to rotate and axially advance linear drive sleeve 40. Second motor 44 continues to rotate until linear drive sleeve 40 has shifted downward a distance to where photo eye emitter 140 and photo eye receiver 142 are aligned with next hole 54 of upper portion 50 of main shaft 38. Once photo eye emitter 140 and photo eye receiver 142 are aligned with hole 54 of upper portion 50 of main shaft 38, logic circuit 48 sends a signal to second motor 44 to stop rotating.

After shuttle assembly 16 has been rotated from first side 32 of page turning device 10 to second side 34 of page turning device 10, logic circuit 48 can be programmed to automatically return shuttles 26 to first side 32 of page turning device after a programmable time delay. For example, logic circuit 48 may be programmed to return shuttle assembly 16 to first side 32 of page turning device 10 after a 30 minute time delay so that page turning device 10 is ready for use after an intermission. Shuttle assembly 16 of page turning device 10 is then positioned in the starting position for its next use.

Figure 19:
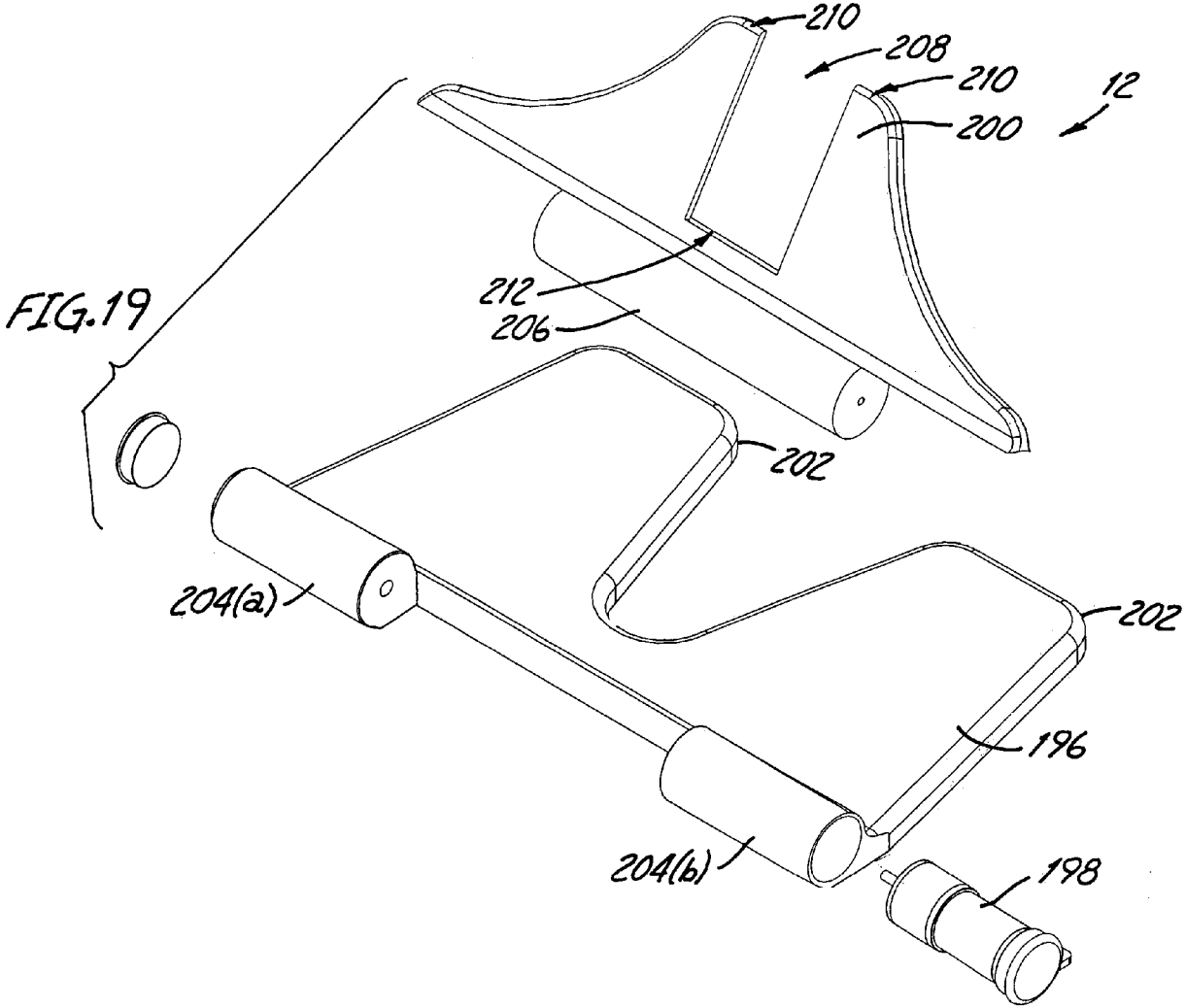
FIG. 19 is an exploded view of the adjustable support of the motorized page turning device of the present invention.

FIG. 19 shows an exploded view of adjustable base 12 for holding page turning device 10 in an upright position as shown in FIG. 1. In a preferred embodiment, adjustable base 12 is motorized. Adjustable base 12 generally comprises base 196, motor 198, and upper support 200.

Base 196 allows adjustable base 12 to be self-standing and supports upper support 200. Base 196 generally comprises base member 202, first rod section 204(*a*), and second rod section 204(*b*). First and second rod sections 204(*a*) and 204(*b*) are located at opposing ends of base 196. In one embodiment, base member 202 comprises a plurality of extensions which lay against the surface where adjustable base 12 stands. Motor 198 is housed within one of rod sections 204(*a*) and 204(*b*) and is used to tilt upper support 200 relative to base 196. In one embodiment, motor 198 is a drive motor.

Upper support 200 is rotatably connected to base 196 by rod 206 which fits between first and second rod sections 204(*a*) and 204(*b*) of base 196. Upper support 200 maintains page turning device 10 in an upright position at a desired angle relative to base 196. Upper support 200 comprises a gap 208 along a top edge 210 of upper support 200 and extending downward toward bottom edge 212 of upper support 200 that is sized to accept page turning device 10.

The motorized page turning device of the present invention quietly and accurately turns pages of a musical composition. The page turning device is mounted on an adjustable base which the user can tilt at varying angles. A shuttle assembly comprising a plurality of shuttles and clips attaches pieces of paper to a shaft disposed within a top, center, and bottom support of the page turning device. The shaft comprises a main shaft having an upper and a lower portion and a linear drive sleeve. A first motor is connected to the upper portion of the main shaft and rotates the main shaft and the shuttle engaged with a drive pin of the shaft approximately 180 degrees. After a time delay or actuation by the user, a second motor connected to the linear drive sleeve axially advances the shaft so that the drive pin of the shaft engages the next shuttle. The motors are controlled by a logic circuit which is operatively connected to a photoeye system that senses rotational and axial movement of the shaft.

Although the present invention has been described with reference to preferred embodiments, workers skilled in the art will recognize that changes may be made in form and detail without departing from the spirit and scope of the invention.

The invention claimed is:

1. A page turning device comprising:

a shaft having a rotatable main shaft and a linear drive sleeve;

a drive pin having first and second ends passing normally through the main shaft;

a plurality of shuttles rotatably connected between the main shaft and the linear drive sleeve, each shuttle having opposing first and second notches located at an interior circumference of the shuttle, the notches being sized to mate with the first and second ends of the drive pin;

means for rotating the shaft;

means for axially advancing the shaft; and means for controlling and sensing motion of the plurality of shuttles and the shaft.

2. The page turning device of claim 1, wherein the main shaft comprises an upper portion and a lower portion.

3. The page turning device of claim 2, wherein the upper portion of the main shaft comprises a plurality of holes for sensing axial and rotational movement of the shaft.

4. The page turning device of claim 3, wherein the linear drive sleeve is threaded.

5. The page turning device of claim 4, wherein the linear drive sleeve comprises a keyway for mating with a screw to prevent the linear drive sleeve from rotating.

6. The page turning device of claim 5, wherein the lower portion of the main shaft is housed within the linear drive sleeve.

7. The page turning device of claim 6, wherein the means for rotating the shaft comprises a rotational drive motor, and wherein the rotational drive motor is connected to the main shaft.

8. The page turning device of claim 7, wherein the means for axially advancing the shaft comprises a linear drive motor, and wherein the linear drive motor is connected to the linear drive sleeve.

9. The page turning device of claim 8 and further comprising a top support having an opening to accept the main shaft, wherein the rotational drive motor is disposed within the top support.

10. The page turning device of claim 9 and further comprising a bottom support having an opening to accept the linear drive sleeve, wherein the linear drive motor is disposed within the bottom support.

11. The page turning device of claim 10, wherein the shaft is positioned through a center support having a first and second opening, the first and second openings of the center support being aligned with the openings of the top and bottom supports.

12. The page turning device of claim 11 and further comprising a backplate for aligning the openings of the top, bottom, and center supports.

13. The page turning device of claim 1, wherein the means for controlling and sensing motion of the plurality of shuttles and the shaft is a logic circuit.

14. The page turning device of claim 1, wherein each of the plurality of shuttles comprises a means for attaching to a sheet of paper.

15. The page turning device of claim 14, wherein the means for attaching to the sheet of paper is a clip.

16. The page turning device of claim 1 and further comprising a shuttle lock for aligning the plurality of shuttles with each other.

17. The page turning device of claim 12 and further comprising a first and second tube disposed within the top and bottom supports, respectively, wherein the upper portion of the main shaft is disposed within the first tube, and wherein the linear drive sleeve is disposed within the second tube.

18. The page turning device of claim 17 and further comprising a retainer located at the base of the first tube, the retainer having an photoeye emitter and a photoeye receiver, the retainer holding the photoeye emitter and receiver in alignment with one of the plurality of holes of the upper portion of the main shaft and a hole of the first tube.

19. The page turning device of claim 1 and further comprising an adjustable base for holding the page turning device in an upright position.

20. The page turning device of claim 19 wherein the adjustable base further comprises a motor for tilting the page turning device at varying angles.

21. The page turning device of claim 1 wherein the page turning device is portable.

22. A device for turning pages comprising:

a shaft having a main shaft and a linear drive sleeve;

a drive pin carried by the shaft;

a plurality of shuttles, each shuttle having a bore sized to accept the shaft and engaging the drive pin, the plurality of shuttles being stacked between the main shaft and the linear drive sleeve and proximate to the drive pin;

a rotational drive for rotating the shaft and one of the plurality of shuttles about 180 degrees; and a linear drive for axially advancing the shaft and drive pin to adjacent shuttles.

23. The device of claim 22, wherein the device for turning pages is portable.

24. The portable page turning device of claim 23, wherein each shuttle has opposing first and second notches located at an interior circumference of the shuttle sized to mate with the drive pin.

25. A portable page turning device comprising:

a shaft having a main shaft and a linear drive sleeve;

a drive pin having first and second ends and passing normally through the main shaft;

a plurality of stacked shuttles rotatably connected to the shaft between the main shaft and the linear drive sleeve, each shuttle having opposing first and second notches located at an interior circumference of the shuttle sized to mate with the first and second ends of the drive pin;

a rotational drive for rotating the shaft;

a linear drive for axially advancing the shaft; and a logic circuit for controlling and sensing motion of the plurality of shuttles and the shaft.

26. A page turning device comprising:

a shaft having a rotatable main shaft and a linear drive sleeve;

a plurality of shuttles stacked between the main shaft and the linear drive sleeve;

means for selectively engaging the shuttles;

means for rotating the shaft; and means for axially advancing the shaft.

27. The page turning device of claim 26, wherein the means for selectively engaging the shuttles is a drive pin passing through the shaft.

28. The page turning device of claim 26, wherein the means for selectively engaging the shuttles is a key connected to the shaft.

29. The page turning device of claim 26, wherein the means for selectively engaging the shuttles is a detent and spring loaded ball.

30. The page turning device of claim 26, wherein the means for selectively engaging the shuttles is a protrusion on the shaft.

31. A page turning device comprising:

a shaft having a rotatable main shaft, linear drive sleeve, and protrusion;

a plurality of shuttles, each shuttle having a bore sized to accept the shaft and engaging the protrusion, the plurality of shuttles being stacked between the main shaft and the linear drive sleeve and proximate to the protrusion;

a rotational drive for rotating the shaft and one of the plurality of shuttles; and a linear drive for axially advancing the protrusion to adjacent shuttles.

32. A method for turning pages, the method comprising:

attaching a first page to a first shuttle rotatably connected to a shaft, the first shuttle comprising a first and a second notch;

attaching a second page to a second shuttle rotatably connected to the shaft, the second shuttle comprising a first and a second notch;

aligning a drive pin connected to the shaft with the notches of the first shuttle;

rotating the shaft until the notches of the first and second shuttles are realigned;

axially advancing the shaft until the drive pin is aligned with the first and second notches of the second shuttle; and rotating the shaft until the notches of the first and second shuttles are realigned.

33. A method for turning pages, the method comprising:

attaching a first page to a first shuttle rotatably connected to a shaft;

attaching a second page to a second shuttle rotatably connected to the shaft;

aligning a protrusion of the shaft with the first shuttle;

rotating the shaft approximately 180 degrees;

axially advancing the shaft until the protrusion is aligned with the second shuttle; and rotating the shaft approximately 180 degrees.

* * * * *

UNITED STATES PATENT AND TRADEMARK OFFICE

CERTIFICATE OF CORRECTION

PATENT NO. : 7,145,069 B2
APPLICATION NO. : 10/946489
DATED : December 5, 2006
INVENTOR(S) : Raymond J. Berg It is certified that error appears in the above-identified patent and that said Letters Patent is hereby corrected as shown below:

Column 2, Line 15, delete "oaf", insert --of a--

Signed and Sealed this

Twenty-seventh Day of February, 2007

JON W. DUDAS
*Director of the United States Patent and Trademark Office*